US010532575B2

(12) United States Patent
Fukunaga et al.

(10) Patent No.: US 10,532,575 B2
(45) Date of Patent: Jan. 14, 2020

(54) INK-JET RECORDING APPARATUS

(71) Applicant: KYOCERA Document Solutions Inc., Osaka (JP)

(72) Inventors: Yasuyuki Fukunaga, Osaka (JP); Masaki Murashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 91 days.

(21) Appl. No.: 15/903,806

(22) Filed: Feb. 23, 2018

(65) Prior Publication Data

US 2018/0272715 A1 Sep. 27, 2018

(30) Foreign Application Priority Data

Mar. 21, 2017 (JP) ..... 2017-054173

(51) Int. Cl.
*B41J 2/165* (2006.01)
*B41J 2/175* (2006.01)
(Continued)

(52) U.S. Cl.
CPC ..... *B41J 2/16511* (2013.01); *B41J 2/14024* (2013.01); *B41J 2/165* (2013.01);
(Continued)

(58) Field of Classification Search
CPC ..... B41J 2/16511; B41J 2/16544; B41J 2/16508; B41J 2/16538; B41J 29/02;
(Continued)

(56) References Cited

U.S. PATENT DOCUMENTS

2005/0168517 A1 8/2005 Usuda ..... 347/29
2016/0075138 A1* 3/2016 Hashimoto ..... B41J 2/16508 347/29

FOREIGN PATENT DOCUMENTS

JP 2005-212378 A 8/2005
JP 2007-216466 A 8/2007
JP 2011-5832 A 1/2011

OTHER PUBLICATIONS

Japanese Office Action dated Oct. 29, 2019, issued by the Japanese Patent Office in corresponding application JP 2017-054173.

* cited by examiner

*Primary Examiner* — Justin Seo
(74) *Attorney, Agent, or Firm* — Stein IP, LLC

(57) ABSTRACT

An ink-jet recording apparatus of the present disclosure includes a recording head, a cap portion, and a moisture-retaining agent supply mechanism. The cap portion caps the recording head. The moisture-retaining agent supply mechanism includes a moisture-retaining agent housing portion that houses a moisture-retaining agent to be supplied into the cap portion, a communication path through which the moisture-retaining agent being supplied from the moisture-retaining agent housing portion to the cap portion passes, a moisture-retaining agent tank that houses the moisture-retaining agent in a liquid state, a supply path through which the moisture-retaining agent being supplied from the moisture-retaining agent tank to the moisture-retaining agent housing portion passes, and a discharge path through which part of the moisture-retaining agent passes, which has overflowed inside the moisture-retaining agent housing portion and returns from the moisture-retaining agent housing portion to the moisture-retaining agent tank.

8 Claims, 17 Drawing Sheets

(51) Int. Cl.

| | |
|---|---|
| ***B41J 2/14*** | (2006.01) |
| ***B41J 2/17*** | (2006.01) |
| ***B41J 2/21*** | (2006.01) |
| ***B41J 29/02*** | (2006.01) |

(52) U.S. Cl.
CPC ..... *B41J 2/16508* (2013.01); *B41J 2/16538* (2013.01); *B41J 2/16544* (2013.01); *B41J 2/16579* (2013.01); *B41J 2/16585* (2013.01); *B41J 2/1721* (2013.01); *B41J 2/1754* (2013.01); *B41J 2/2103* (2013.01); *B41J 29/02* (2013.01); *B41J 2002/16502* (2013.01); *B41J 2202/20* (2013.01)

(58) Field of Classification Search
CPC ..... B41J 2/165; B41J 2/16585; B41J 2/2103; B41J 2/1721; B41J 2/14024; B41J 2/1754; B41J 2/16579; B41J 2202/20; B41J 2002/16502
See application file for complete search history.

INK-JET RECORDING APPARATUS

INCORPORATION BY REFERENCE

This application is based upon and claims the benefit of priority from the corresponding Japanese Patent Application No. 2017-054173 filed on Mar. 21, 2017, the entire contents of which are incorporated herein by reference.

BACKGROUND

The present disclosure relates to an ink-jet recording apparatus provided with a recording head that ejects ink onto a recording medium such as a paper sheet and a cap unit that caps an ink ejection surface of the recording head.

An ink-jet recording apparatus that ejects ink and forms an image with the ink is capable of forming a high-definition image and thus has been widely used as a recording apparatus such as a facsimile, a copy machine, or a printer.

Conventionally, in an ink-jet recording apparatus, in order to prevent drying and clogging of an ejection nozzle of a recording head, typically, the recording head is kept capped in a case where printing is not scheduled to be performed for a long period of time. Furthermore, it is also common to perform a recovery process in which ink thickened in the ejection nozzle is forcibly extruded through the ejection nozzle and wiped off by a wiper. Thus, in the ink-jet recording apparatus, there are provided a recording head that ejects ink onto a recording medium, a cap unit having a cap portion that caps an ink ejection surface of the recording head, and a wipe unit that performs a recovery process with respect to the recording head.

In a case of capping the recording head, the cap portion is disposed so as to come into tight contact with the ink ejection surface of the recording head. In a case of not capping the recording head, the cap portion is disposed at a retracted position retracted from the recording head.

SUMMARY

An ink-jet recording apparatus according to a first aspect of the present disclosure is provided with a plurality of recording heads, a cap unit, and a moisture-retaining agent supply mechanism. Each of the plurality of recording heads has an ink ejection surface on which an ejection nozzle for ejecting ink is open. The cap unit has a plurality of cap portions that each cap the ink ejection surface. The moisture-retaining agent supply mechanism supplies a moisture-retaining agent in a liquid state or a gas state into each of the plurality of cap portions. The moisture-retaining agent supply mechanism includes a moisture-retaining agent housing portion that is provided below the plurality of cap portions and houses the liquid-state moisture-retaining agent, a communication path that connects the moisture-retaining agent housing portion to the plurality of cap portions and through which the moisture-retaining agent being supplied from the moisture-retaining agent housing portion to the plurality of cap portions passes, a moisture-retaining agent tank that houses the liquid-state moisture-retaining agent to be supplied to the moisture-retaining agent housing portion, a supply path that connects the moisture-retaining agent housing portion to the moisture-retaining agent tank and through which the moisture-retaining agent being supplied from the moisture-retaining agent tank to the moisture-retaining agent housing portion passes, and a discharge path that connects the moisture-retaining agent housing portion to the moisture-retaining agent tank and through which part of the moisture-retaining agent passes, which has overflowed inside the moisture-retaining agent housing portion and returns from the moisture-retaining agent housing portion to the moisture-retaining agent tank.

Still other objects of the present disclosure and specific advantages provided by the present disclosure will be made further apparent from the following description of an embodiment.

DETAILED DESCRIPTION

With reference to the appended drawings, the following describes an embodiment of the present disclosure.

Figure 1:
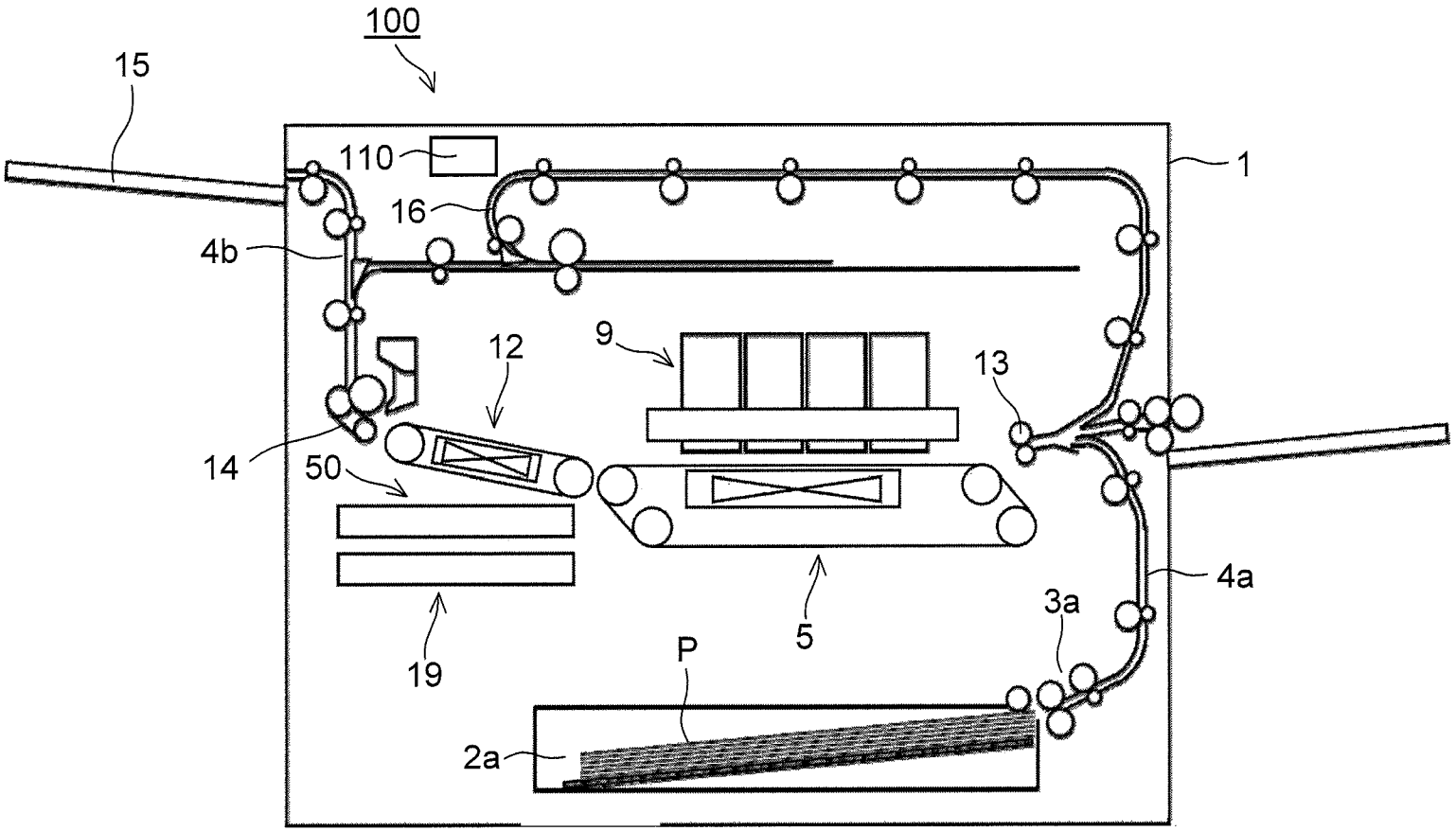
FIG. 1 is a view showing a schematic structure of a printer according to one embodiment of the present disclosure.

With reference to FIG. 1 to FIG. 32, a description is given of an ink-jet type printer 100 (an ink-jet recording apparatus) according to one embodiment of the present disclosure. As shown in FIG. 1, in the printer 100, a paper feed cassette 2*a* that is a paper sheet housing portion is disposed on a lower side in a printer main body 1. A paper sheet P that is one example of a recording medium is housed inside the paper feed cassette 2*a*. A paper feed device 3*a* is disposed on a downstream side of the paper feed cassette 2*a* in a paper sheet conveyance direction, i.e., on an upper right side of the paper feed cassette 2*a* in FIG. 1. By the paper feed device 3*a*, the paper sheet P is fed out one by one separately toward the upper right side of the paper feed cassette 2*a* in FIG. 1.

Furthermore, the printer 100 is provided inside with a first paper sheet conveyance path 4*a*. When it comes to the paper feed cassette 2*a*, the first paper sheet conveyance path 4*a* is positioned on the upper right side that is a paper feed direction thereof. The paper sheet P fed out from the paper feed cassette 2*a* is conveyed perpendicularly upward along a side surface of the printer main body 1 via the first paper sheet conveyance path 4*a*.

A registration roller pair 13 is provided at a downstream end of the first paper sheet conveyance path 4*a* with respect to the paper sheet conveyance direction. Moreover, a first conveyance unit 5 and a recording portion 9 are disposed immediately near a downstream side of the registration roller pair 13 in the paper sheet conveyance direction. The paper sheet P fed out from the paper feed cassette 2*a* passes through the first paper sheet conveyance path 4*a* to reach the registration roller pair 13. While correcting oblique feeding of the paper sheet P, the registration roller pair 13 feeds out the paper sheet P toward the first conveyance unit 5 in accordance with timing of an ink ejection operation carried out by the recording portion 9.

A second conveyance unit 12 is disposed on a downstream side of the first conveyance unit 5 with respect to the paper sheet conveyance direction (a left side in FIG. 1). The paper sheet P on which an ink image has been recorded at the recording portion 9 is sent to the second conveyance unit 12 where aqueous ink ejected on a surface of the paper sheet P is dried while the paper sheet P passes through the second conveyance unit 12.

A de-curler portion 14 is provided on a downstream side of the second conveyance unit 12 with respect to the paper sheet conveyance direction and in a neighborhood of a left side surface of the printer main body 1. The paper sheet P on which the ink has been dried at the second conveyance unit 12 is sent to the de-curler portion 14 where a curl generated in the paper sheet P is corrected.

A second paper sheet conveyance path 4*b* is provided on a downstream side of the de-curler portion 14 with respect to the paper sheet conveyance direction (an upper side in FIG. 1). In a case of not performing double-sided recording, the paper sheet P that has passed through the de-curler portion 14 is discharged on a paper sheet discharge tray 15 that is provided outside the left side surface of the printer 100 from the second paper sheet conveyance path 4*b*.

An inversion conveyance path 16 for performing double-sided recording is provided in an upper portion in the printer main body 1 and above the recording portion 9 and the second conveyance unit 12. In a case of performing double-sided recording, the paper sheet P on which recording with respect to a first surface thereof has been completed and that has passed through the second conveyance unit 12 and the de-curler portion 14 is sent to the inversion conveyance path 16 via the second paper sheet conveyance path 4*b*. A conveyance direction of the paper sheet P thus sent to the inversion conveyance path 16 is switched for recording with respect to a second surface thereof, and the paper sheet P is sent rightward by passing through the upper portion of the printer main body 1. Then, via the first paper sheet conveyance path 4*a* and the registration roller pair 13, with the second surface faced upward, the paper sheet P is sent again to the first conveyance unit 5.

Furthermore, a wipe unit 19 and a cap unit 50 are disposed below the second conveyance unit 12. When carrying out after-mentioned purging, the wipe unit 19 horizontally moves to below the recording portion 9, where the wipe unit 19 wipes off ink extruded through an ejection nozzle of a recording head and collects the ink thus wiped off. When capping an ink ejection surface of the recording head, the cap unit 50 horizontally moves to below the recording portion 9 and further moves upward to be mounted to a lower surface of the recording head.

Figure 2:
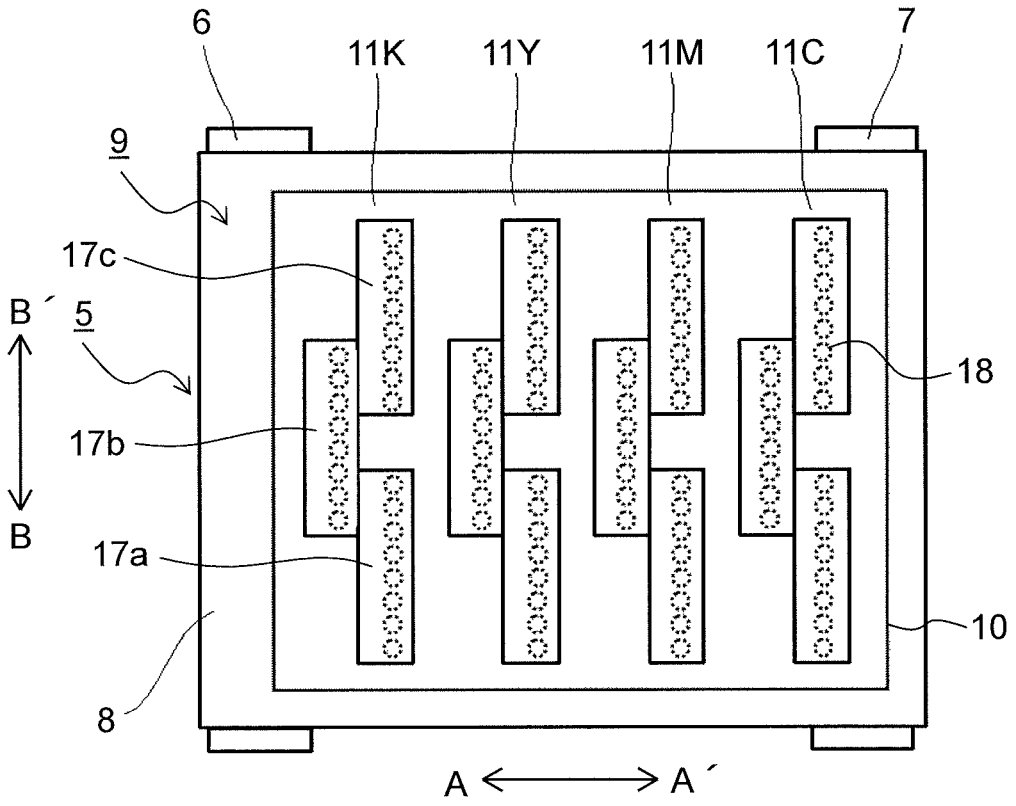
FIG. 2 is a view showing, from above, a first conveyance unit and a recording portion of the printer according to the one embodiment of the present disclosure.
Figure 3:
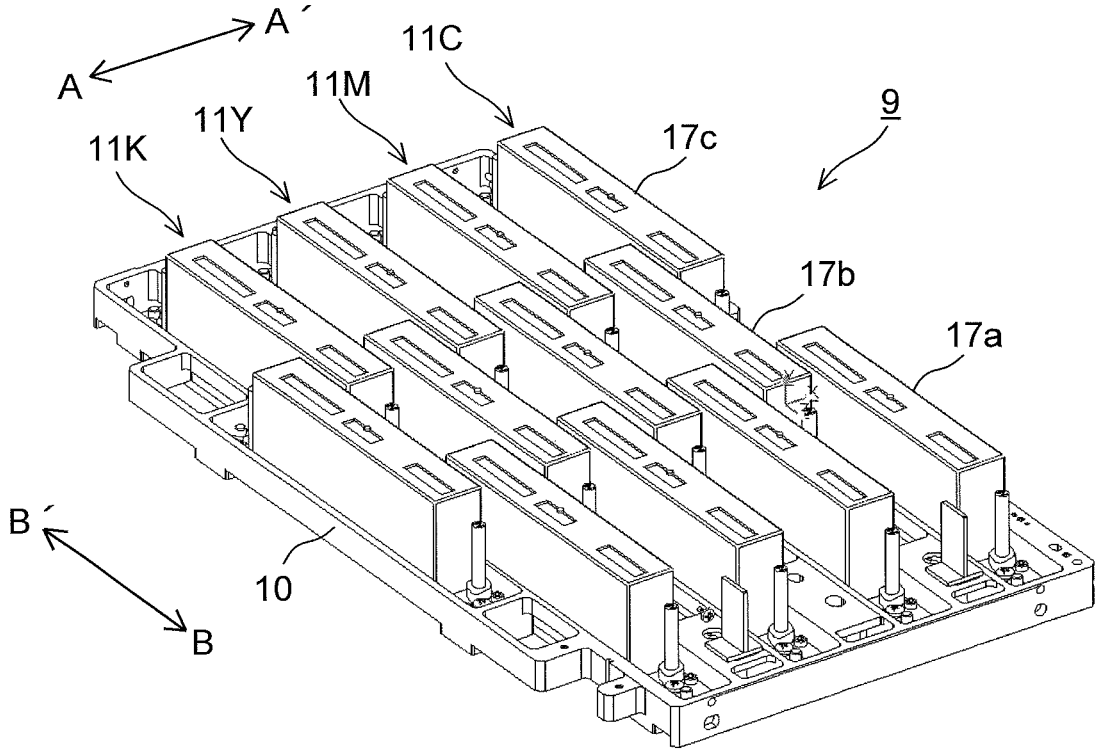
FIG. 3 is a view showing a structure of the recording portion of the printer according to the one embodiment of the present disclosure.

As shown in FIG. 2 and FIG. 3, the recording portion 9 is provided with a head housing 10 and line heads 11C, 11M, 11Y, and 11K retained in the head housing 10. The line heads 110, 11M, 11Y, and 11K are supported at such a height that a prescribed spacing (for example, 1 mm) is formed with respect to a conveyance surface of a first conveyance belt 8 that is stretched over a plurality of rollers including a driving roller 6 and a driven roller 7. Each of the line heads 110, 11M, 11Y, and 11K is formed by arranging a plurality of (herein, three) recording heads 17*a* to 17*c* in a staggered manner along a paper sheet width direction (an arrow BB' direction) orthogonal to the paper sheet conveyance direction (an arrow A direction).

Figure 4:
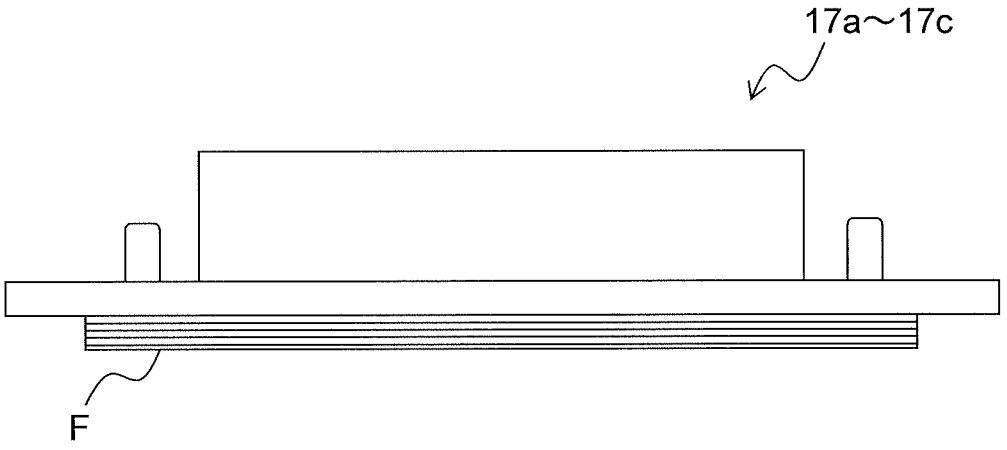
FIG. 4 is a view showing a structure of a recording head as a component of a line head of the recording portion of the printer according to the one embodiment of the present disclosure.
Figure 5:
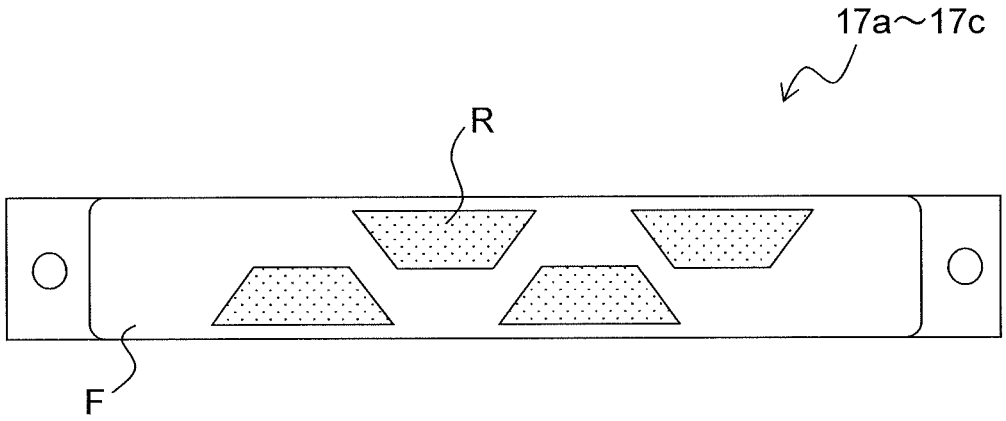
FIG. 5 is a view showing, from an ink ejection surface side, the recording head of the printer according to the one embodiment of the present disclosure.

As shown in FIG. 4 and FIG. 5, on an ink ejection surface F of each of the recording heads 17*a* to 17*c*, there is provided a nozzle region R in which a multitude of ejection nozzles 18 (see FIG. 2) are arranged. Since the recording heads 17*a* to 17*c* are the same in shape and configuration, FIG. 4 and FIG. 5 show one recording head representing each of the recording heads 17*a* to 17*c*.

The recording heads 17*a* to 17*c* constituting each of the line heads 110, 11M, 11Y, and 11K are supplied with ink of one of four colors (cyan, magenta, yellow, and black) stored in ink tanks (not shown), respectively, so as to correspond to respective colors of the line heads 110, 11M, 11Y, and 11K.

In accordance with image data received from an external computer or the like in the form of a control signal from a control portion 110 (see FIG. 1) that controls the printer 100 as a whole, each of the recording heads 17*a* to 17*c* ejects ink through the ejection nozzles 18 toward the paper sheet P as conveyed while being sucked and retained on the conveyance surface of the first conveyance belt 8. In this manner, on the paper sheet P on the first conveyance belt 8, ink images of the four colors of cyan, magenta, yellow, and black are superimposed on each other to form a color image.

Furthermore, in order to prevent poor ink ejection due to drying or clogging of the recording heads 17*a* to 17*c*, purging is carried out in which ink increased in viscosity in the ejection nozzles 18 of the recording heads 17*a* to 17*c* is extruded through the ejection nozzles 18, thus preparing for a next printing operation. In the purging, at a start of printing after a long-term shutdown, such ink is ejected through all of the ejection nozzles 18, and in an interim between printing operations, such ink is ejected through some of the ejection nozzles 18 that have an ink ejection amount of not more than a set value.

Next, a detailed description is given of a structure in a vicinity of the cap unit 50 and the wipe unit 19.

Figure 6:
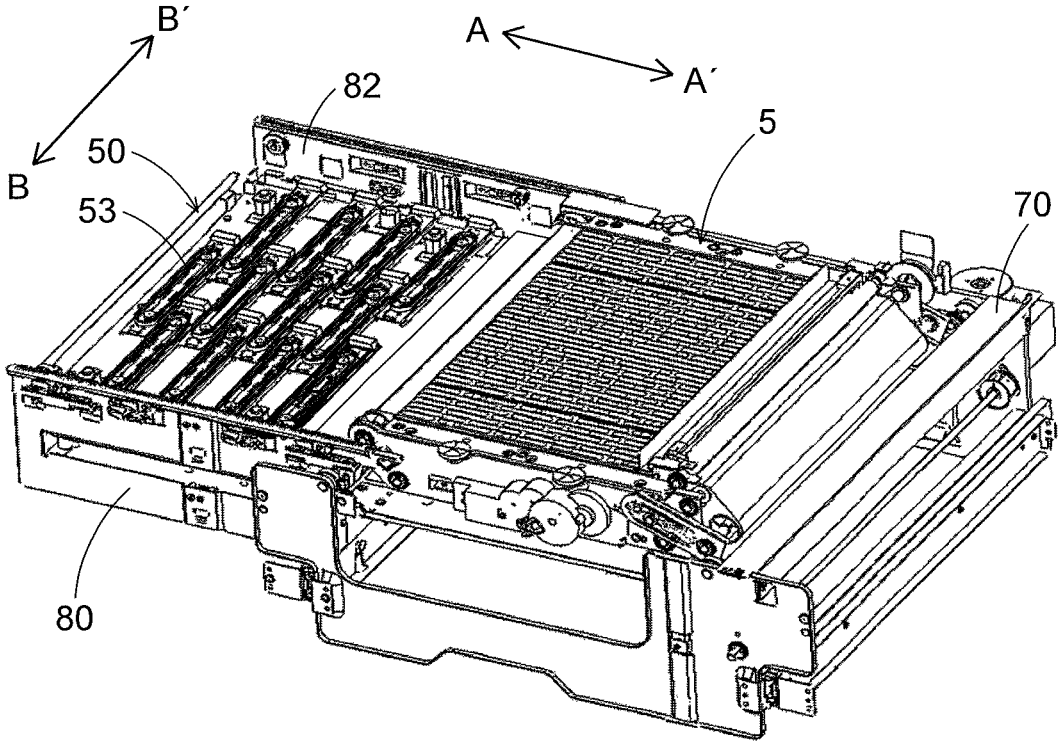
FIG. 6 is a view showing a structure of a cap unit, the first conveyance unit, and so on of the printer according to the one embodiment of the present disclosure, which illustrates a state where the first conveyance unit is disposed at a raised position.
Figure 7:
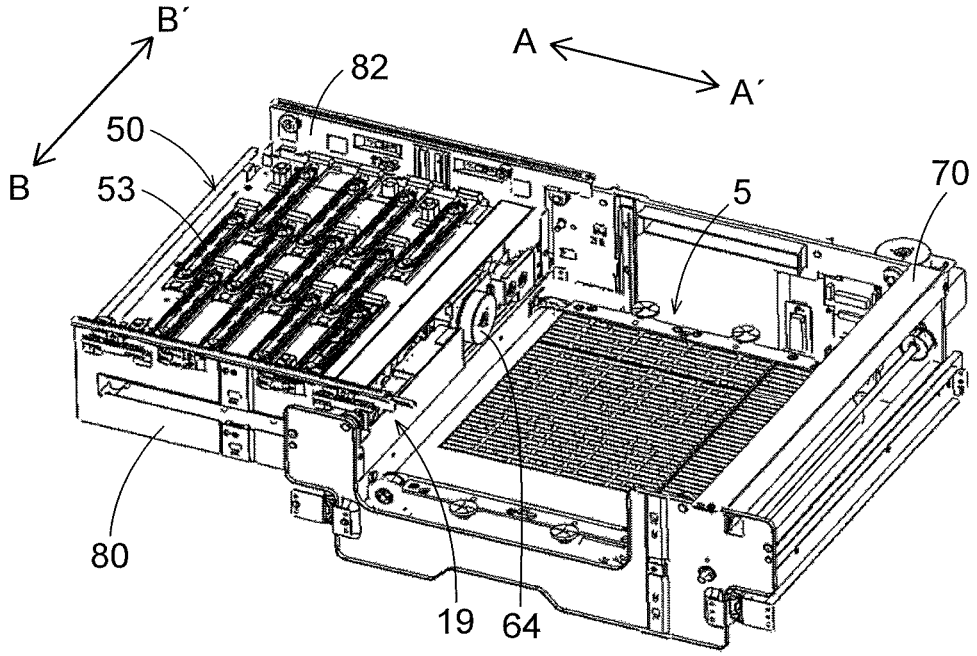
FIG. 7 is a view showing the structure of the cap unit, the first conveyance unit, and so on of the printer according to the one embodiment of the present disclosure, which illustrates a state where the first conveyance unit is disposed at a lowered position.

As shown in FIG. 6 and FIG. 7, the first conveyance unit 5 is housed in a housing frame 70. The first conveyance unit 5 is configured to be ascendible/descendible in an up-down direction by a conveyance ascending/descending mechanism (not shown) composed of an ascending/descending drive source, a gear train, and so on. At a time of a printing operation, the first conveyance unit 5 is disposed at a raised position (a position shown in FIG. 6) and thus is in proximity to the ink ejection surface F of each of the recording heads 17*a* to 17*c*. Furthermore, at a time of an after-mentioned recovery operation and a time of an after-mentioned capping operation with respect to the recording heads 17*a* to 17*c*, the first conveyance unit 5 is disposed at a lowered position (a position shown in FIG. 7).

Figure 8:
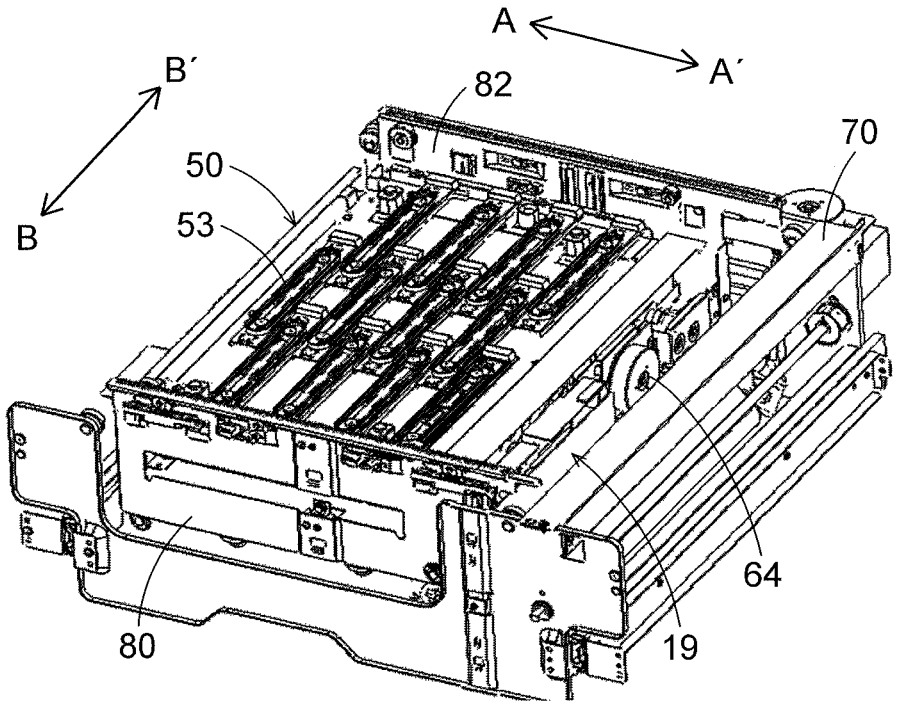
FIG. 8 is a view showing a structure of the cap unit and so on of the printer according to the one embodiment of the present disclosure, which illustrates a state where the cap unit and a wipe unit are disposed at a first position.
Figure 9:
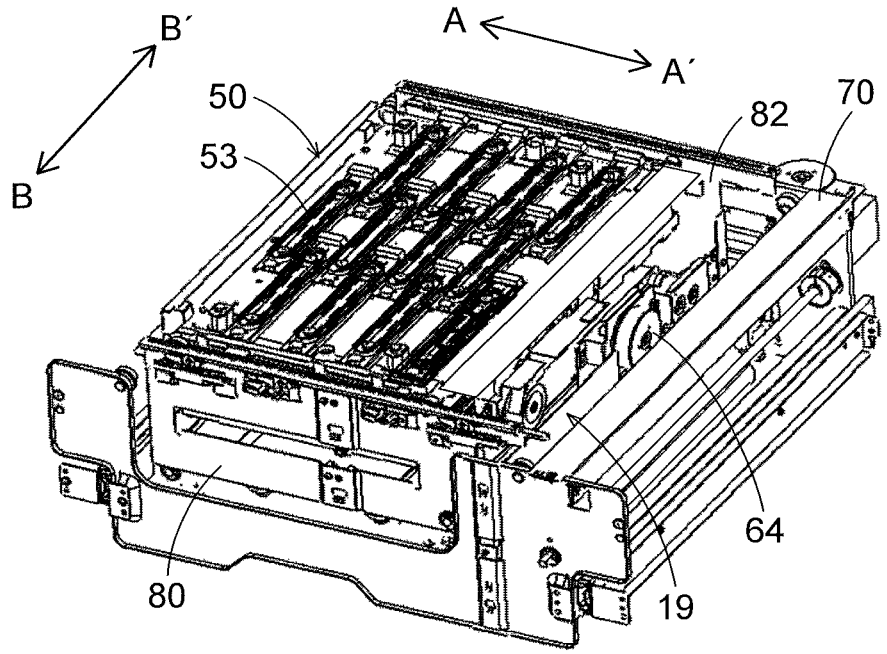
FIG. 9 is a view illustrating a state where the cap unit and the wipe unit have ascended from the state shown in FIG. 8.

As shown in FIG. 7 and FIG. 8, the cap unit 50 is configured to be able to reciprocate between a first position (a position shown in FIG. 8) directly below the recording portion 9 and a second position (a retracted position, a position shown in FIG. 7) retracted in a horizontal direction (the arrow A direction) from the first position. In a case where the cap unit 50 is disposed at the first position, the first conveyance unit 5 is disposed at the lowered position. Furthermore, as shown in FIG. 8 and FIG. 9, the cap unit 50 is configured to be ascendible/descendible in the up-down direction when at the first position.

At a time of a printing operation and a time of a recovery operation, the cap unit 50 is disposed at the second position (the position shown in FIG. 6). The cap unit 50 is configured so that, at a time of a capping operation, it moves upward at the first position (the position shown in FIG. 8 and FIG. 9) so as to cap the recording heads 17*a* to 17*c*. As will be mentioned later, the cap unit 50 is configured to be able to be joined to/disjoined from the wipe unit 19 when at the second position. The cap unit 50 moves in the horizontal direction and in the up-down direction in a state where the wipe unit 19 is joined to the cap unit 50.

Figure 10:
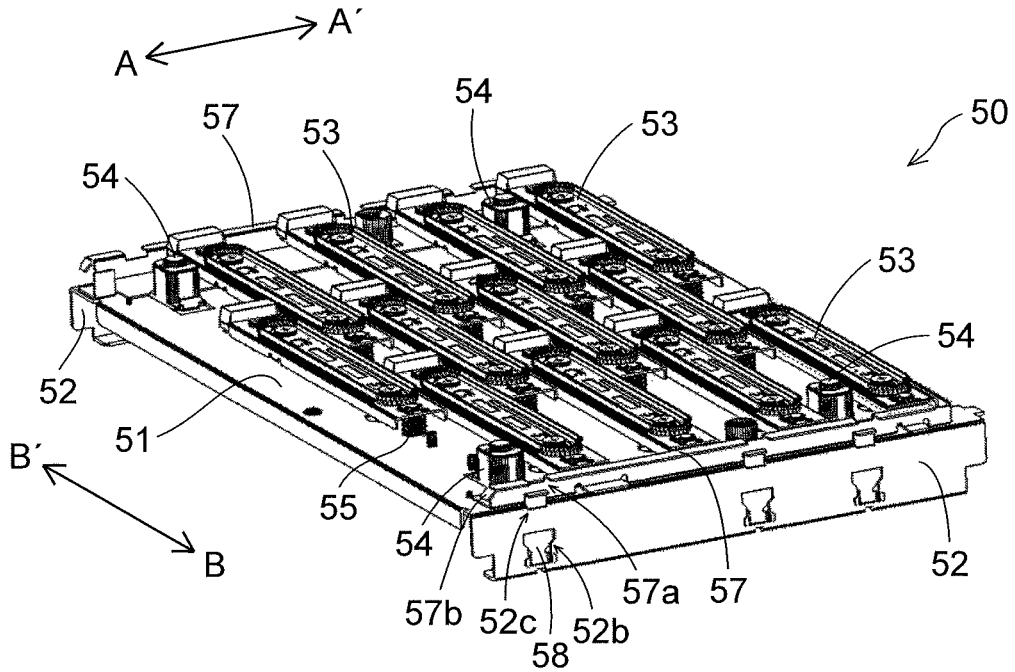
FIG. 10 is a view showing a structure of the cap unit of the printer according to the one embodiment of the present disclosure.

As shown in FIG. 10, the cap unit 50 includes a cap tray 51 that is made of sheet metal, a pair of tray side plates 52 that are formed on both ends of the cap tray 51 in the paper sheet width direction (the arrow BB' direction), 12 concave cap portions 53 that are disposed on an upper surface of the cap tray 51, and four height-direction positioning protrusions 54.

The cap portions 53 are disposed at positions corresponding to the recording heads 17*a* to 17*c*. With this configuration, as shown in FIG. 9, the cap unit 50 moves upward at the first position, and thus each of the cap portions 53 caps the ink ejection surface F of each of the recording heads 17*a* to 17*c*. The cap portions 53 are each formed of an elastic member made of, for example, EPDM, a synthetic resin, or the like. When the cap unit 50 is caused to ascend to a recording portion 9 side so as to cap the recording heads 17*a* to 17*c*, the height-direction positioning protrusions 54 come into contact with the housing 10 of the recording portion 9 and thus performs positioning of the cap tray 51 in a height direction. A cap spring 55 formed of a compression spring is disposed between a lower portion of each of the cap portions 53 on each of both sides in a longitudinal direction thereof (the arrow BB' direction) and the cap tray 51. By the cap spring 55, a contact state between each of the cap portions 53 and the ink ejection surface F is retained constant.

Furthermore, the cap portions 53 are configured so that a moisture-retaining agent in a liquid state or a gas state is supplied thereinto from an after-mentioned moisture-retaining agent supply mechanism 130.

Figure 11:
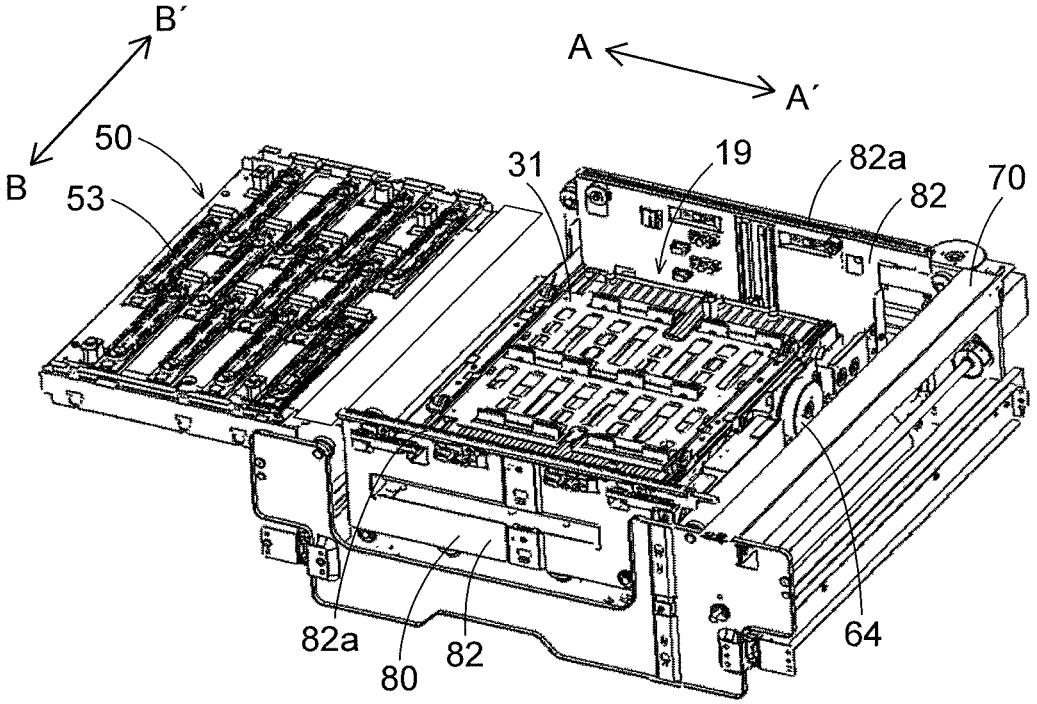
FIG. 11 is a view showing a structure of the cap unit, the wipe unit, and so on of the printer according to the one embodiment of the present disclosure, which illustrates a state where the cap unit is disposed at a second position, while the wipe unit is disposed at the first position.

As shown in FIG. 7 and FIG. 11, the wipe unit 19 is configured to be able to reciprocate between the first position (a position shown in FIG. 11) directly below the recording portion 9 and the second position (the retracted position, the position shown in FIG. 7) retracted in the horizontal direction (the arrow A direction) from the first position. In a case where the wipe unit 19 is disposed at the first position, the first conveyance unit 5 is disposed at the lowered position. Furthermore, as shown in FIG. 11 and FIG. 12, the wipe unit 19 is configured to be ascendible/descendible in the up-down direction when at the first position.

At a time of a printing operation, the wipe unit 19 is disposed at the second position. The wipe unit 19 is configured so that, at a time of a recovery operation and a time of a capping operation, it moves upward at the first position (the position shown in FIG. 11).

Figure 12:
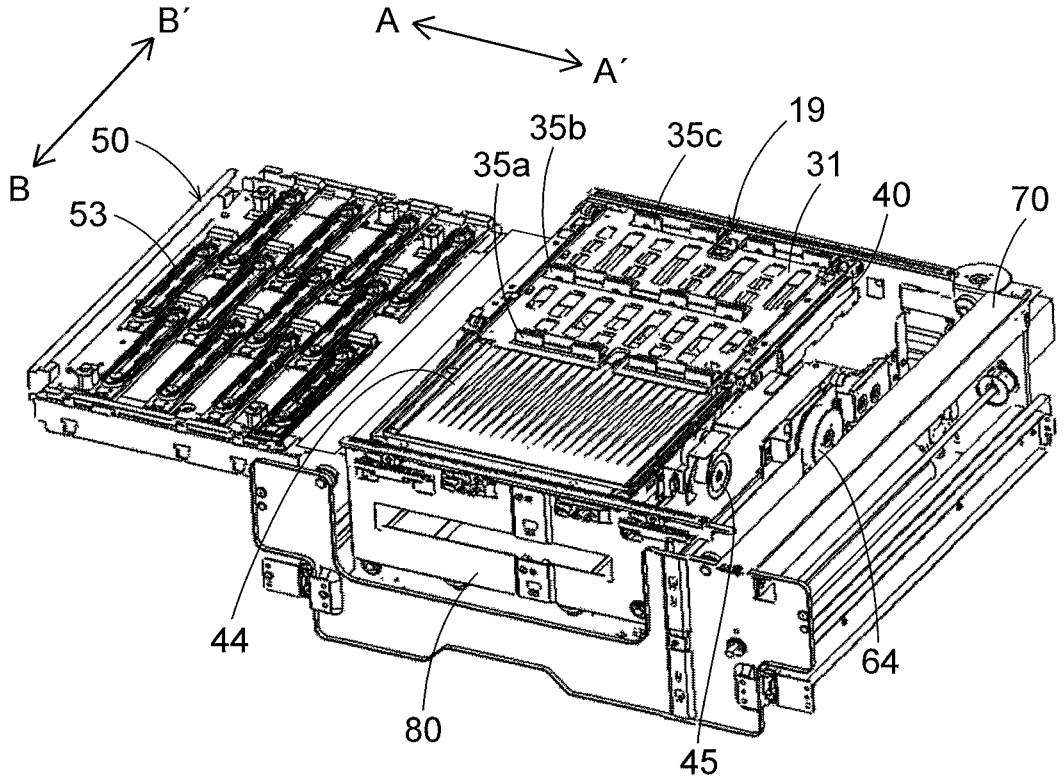
FIG. 12 is a view illustrating a state where the wipe unit has ascended from the state shown in FIG. 11.
Figure 13:
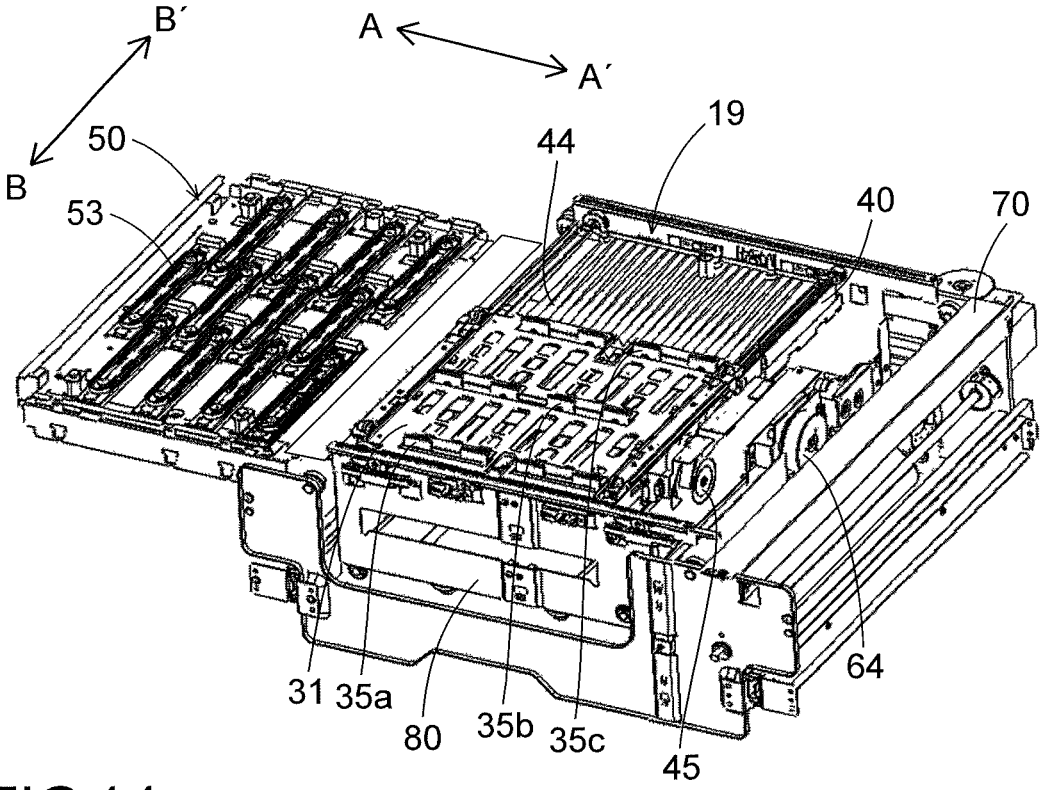
FIG. 13 is a view illustrating a state where a wiper carriage has been moved in an arrow B direction from the state shown in FIG. 12.

As shown in FIG. 12 and FIG. 13, the wipe unit 19 is composed of a substantially rectangular wiper carriage 31 on which a plurality of wipers 35*a* to 35*c* are secured and a support frame 40 that supports the wiper carriage 31. The wiper carriage 31 is supported so as to be slidable in the arrow BB' direction with respect to the support frame 40.

A wiper carriage movement motor 45 for moving the wiper carriage 31 in the horizontal direction (the arrow BB' direction) and a gear train (not shown) that is meshed with the wiper carriage movement motor 45 and rack teeth (not shown) of the wiper carriage 31 are mounted to an outer side of the support frame 40. The wiper carriage movement motor 45 rotates forward/backward, thus causing the gear train to rotate forward/backward, so that the wiper carriage 31 reciprocates in the horizontal direction (the arrow BB' direction).

The wipers 35*a* to 35*c* are each an elastic member (for example, a rubber member made of EPDM) for wiping off ink extruded through the ejection nozzles 18 of each of the recording heads 17*a* to 17*c*. From a substantially perpendicular direction, the wipers 35*a* to 35*c* are brought into pressure contact with a wiping start position on an outer side of the nozzle region R (see FIG. 5) in which a nozzle surface of each of the ejection nozzles 18 is exposed, and wipe the ink ejection surface F including the nozzle region R in a prescribed direction (an arrow B direction in FIG. 12) as the wiper carriage 31 moves.

Four wipers 35*a* are arranged at substantially regular intervals, and similarly, four wipers 35*b* and four wipers 35*c* are also arranged at substantially regular intervals. The wipers 35*a* and the wipers 35*c* are arranged at positions corresponding to the recording heads 17*a* and the recording heads 17*c* (see FIG. 3) as components of the line heads 11C, 11M, 11Y, and 11K, respectively. Furthermore, the wipers 35*b* are arranged at a position corresponding to the recording heads 17*b* (see FIG. 3) as components of the line heads 11C, 11M, 11Y, and 11K and secured so as to be shifted by a prescribed distance in a direction (an arrow AA' direction) orthogonal to a moving direction of the wiper carriage 31 with respect to the wipers 35*a* and 35*c*.

An ink collection tray 44 for collecting waste ink wiped off from the ink ejection surface F by the wipers 35*a* to 35*c* is disposed on an upper surface of the support frame 40.

Furthermore, as shown in FIG. 7, the wipe unit 19 is housed in a carriage 80 that has a U-shaped cross section, and when at the second position, the wipe unit 19 is disposed below the cap unit 50. In a case of moving in the horizontal direction (the arrow AA' direction) as shown in FIG. 7 and FIG. 11, the wipe unit 19 moves integrally with the carriage 80, and in a case of moving in the up-down direction as shown in FIG. 11 and FIG. 12, the wipe unit 19 moves in the up-down direction with respect to the carriage 80.

Figure 14:
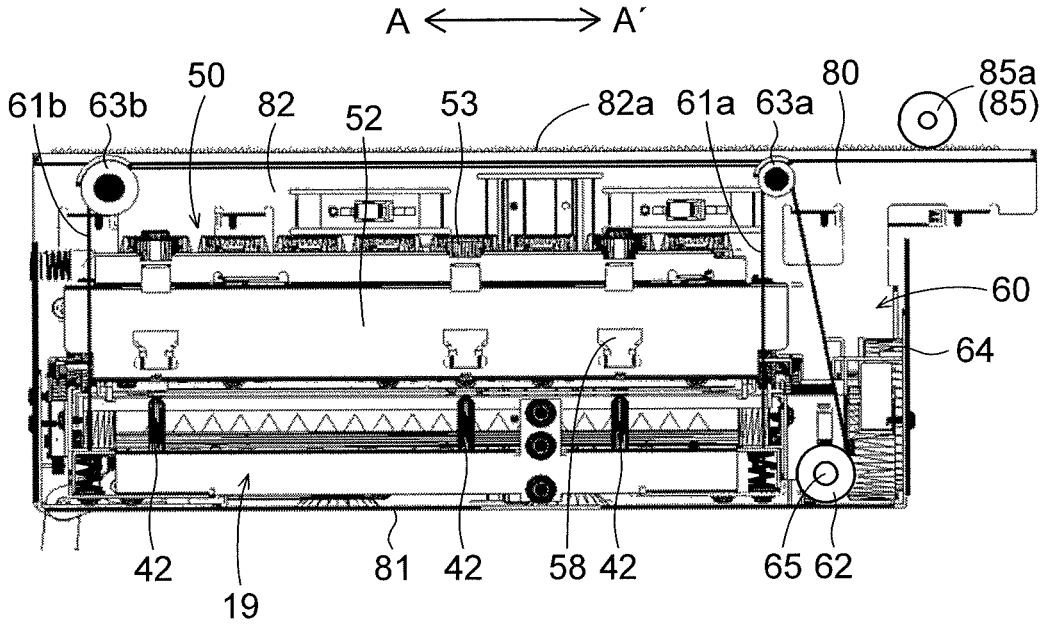
FIG. 14 is a view showing a structure in a vicinity of a unit ascending/descending mechanism of the printer according to the one embodiment of the present disclosure.

The carriage 80 is composed of a carriage bottom plate 81 (see FIG. 14) that is made of sheet metal and on which the wipe unit 19 is placed and a pair of carriage side plates 82 that are provided in a standing manner at both ends of the carriage bottom plate 81 in the paper sheet width direction (the arrow BB' direction). The carriage side plates 82 are configured to be slidable with respect to carriage support rails (not shown) of the printer main body 1. As shown in FIG. 14, a rack portion 82*a* having rack teeth is formed on an upper surface of each of the carriage side plates 82. A gear 85*a* is meshed with the rack portion 82*a*, and a gear train including the gear 85*a* is linked to a carriage drive source (not shown) formed of a motor. The carriage drive source rotates forward/backward, thus causing the gear train to rotate forward/backward, so that the carriage 80 reciprocates between the first position and the second position. The gear train including the gear 85*a* and the carriage drive source constitute a unit horizontal movement mechanism 85 that moves the cap unit 50 and the wipe unit 19 in the horizontal direction.

As shown in FIG. 14, a unit ascending/descending mechanism 60 that causes the wipe unit 19 to ascend/descend in the up-down direction is provided inside the carriage 80. The unit ascending/descending mechanism 60 includes wires 61*a* and 61*b*, a winding pulley 62 that winds the wires 61*a* and 61*b*, pulleys 63*a* and 63*b* that change over directions of the wires 61*a* and 61*b*, and a winding drive motor (a winding drive source) 64.

The wire 61*a* extends from the winding pulley 62 and is mounted to a lower portion of the wipe unit 19 in an arrow A' direction via the pulley 63*a*. The wire 61*b* extends from the winding pulley 62 and is mounted to a lower portion of the wipe unit 19 in the arrow A direction via the pulleys 63*a* and 63*b*. One each of the wires 61*a* and 61*b*, the winding pulley 62, and the pulleys 63*a* and 63*b* is provided on each of both sides in the arrow BB' direction (on a forward side and a depth side with respect to a paper plane of FIG. 14). A pair of winding pulleys 62 are secured to both ends of one rotation shaft 65, respectively. A rotation shaft gear (not shown) that is meshed with a gear train (not shown) linked to the winding drive motor 64 is secured to the rotation shaft 65. The winding drive motor 64 rotates forward/backward, thus causing the winding pulleys 62 to rotate forward/backward.

Figure 15:
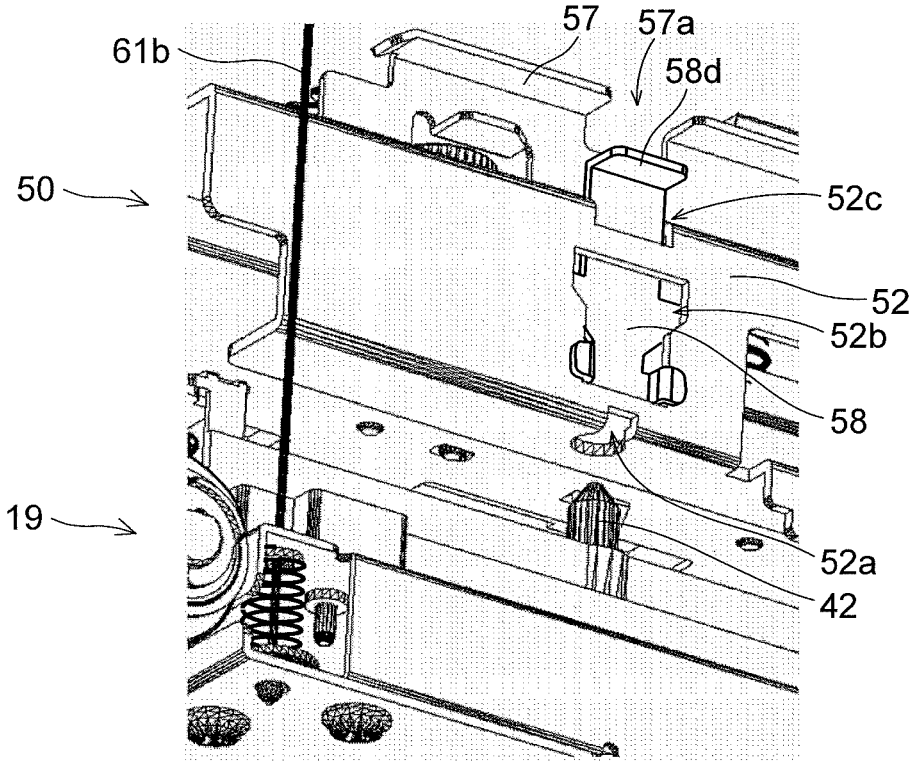
FIG. 15 is a view showing a structure in a vicinity of a joint pin and a push-up piece of the printer according to the one embodiment of the present disclosure, which illustrates a state where the wipe unit and the cap unit are not joined to each other.

Furthermore, as shown in FIG. 14 and FIG. 15, a plurality of joint pins 42 extending upward are provided in the wipe unit 19. In a lower surface of each of the tray side plates 52 of the cap unit 50, joint holes 52*a* (see FIG. 15) are formed at positions corresponding to the joint pins 42, respectively. The joint pins 42 and the joint holes 52*a* constitute a joint mechanism that joins the cap unit 50 and the wipe unit 19 to each other or disjoins them from each other.

Figure 16:
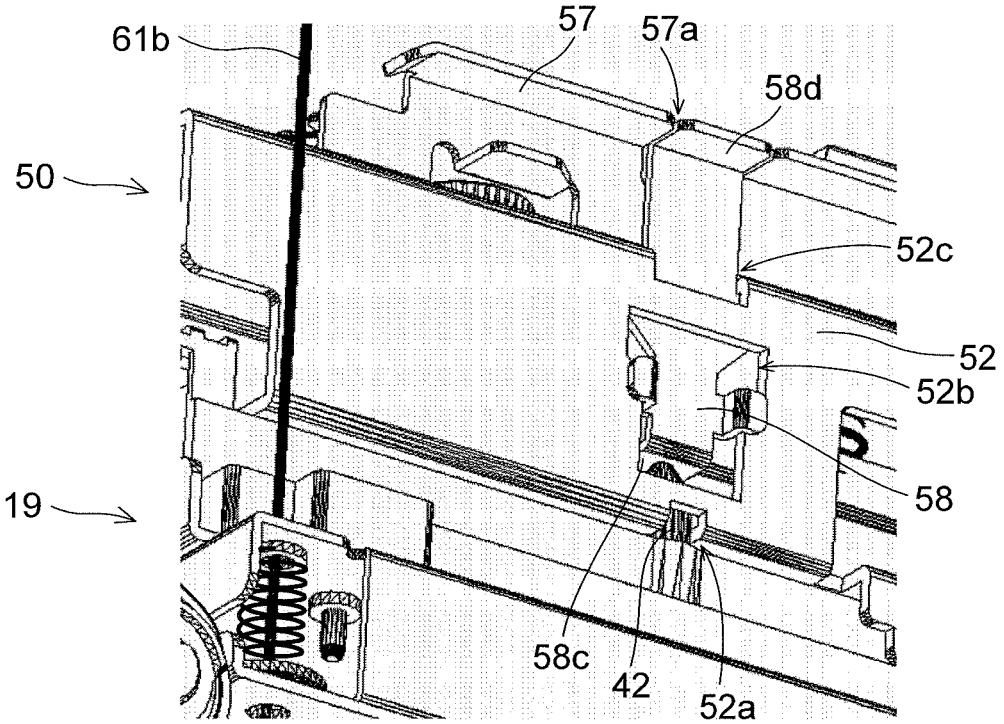
FIG. 16 is a view showing the structure in the vicinity of the joint pin and the push-up piece of the printer according to the one embodiment of the present disclosure, which illustrates a state where the wipe unit and the cap unit are joined to each other.

In a state where the wipe unit 19 has descended at the second position (a state shown in FIG. 14, a state of being disposed at a first height position), as shown in FIG. 15, the joint pins 42 are not inserted into the joint holes 52*a*, and thus the wipe unit 19 and the cap unit 50 are not joined to each other (disjoined from each other). On the other hand, when the wipe unit 19 ascends at the second position, as shown in FIG. 16, the joint pins 42 are inserted into the joint holes 52*a*, and thus the wipe unit 19 and the cap unit 50 are joined to each other. This makes it possible for the cap unit 50 to move in the horizontal direction and the up-down direction integrally with the wipe unit 19.

Figure 17:
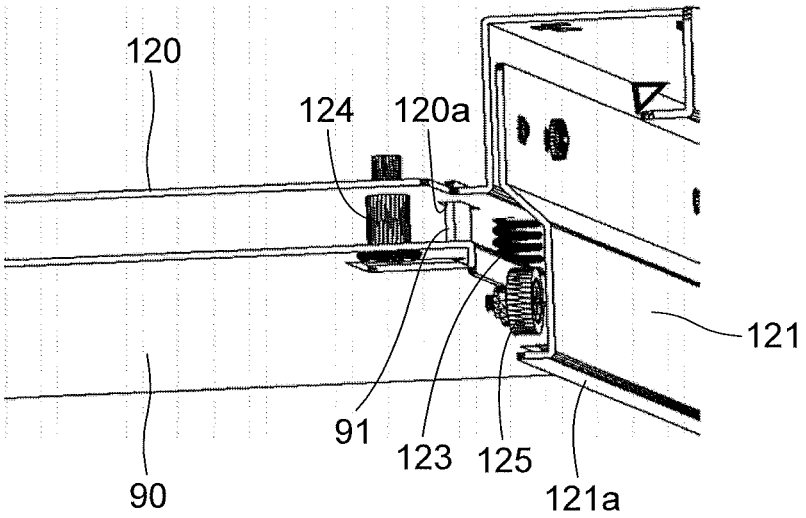
FIG. 17 is a view showing a structure in a vicinity of a lid member and a main body stay of the printer according to the one embodiment of the present disclosure.

As shown in FIG. 17, at the second position, there are provided a main body stay 120 that is provided in the printer main body 1 and a stay side plate 121 that is secured to the main body stay 120. A cap support portion 121*a* that is bent in the horizontal direction is formed in a lower portion of the stay side plate 121. In a state where the wipe unit 19 and the cap unit 50 are not joined to each other (a state of being disjoined from each other), the cap support portion 121*a* supports the cap unit 50.

Furthermore, at the second position, there is provided a lid member 90 that, in a state where the wipe unit 19 and the cap unit 50 are not joined to each other (a state at times other than a time of a capping operation (a time of a printing operation and a time of a recovery operation)), comes into tight contact with the cap portions 53 of the cap unit 50 so as to protect the cap portions 53. The lid member 90 is formed of a plate made of SUS (stainless steel), a resin, or the like. The lid member 90 comes into tight contact with the cap portions 53 from above, thus preventing a foreign substance such as dust or paper powder from adhering to an upper surface of each of the cap portions 53 (a surface thereof that comes into tight contact with the ink ejection surface F) and suppressing evaporation of moisture inside the cap portions 53.

Figure 18:
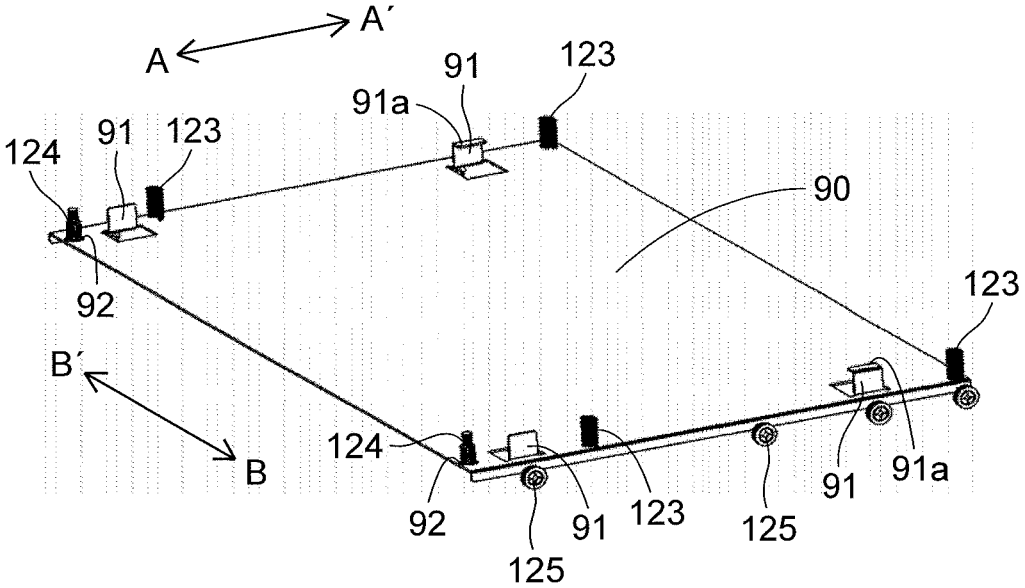
FIG. 18 is a view showing a structure of the lid member of the printer according to the one embodiment of the present disclosure.

As shown in FIG. 17 and FIG. 18, the lid member 90 is disposed below the main body stay 120. In FIG. 18, the main body stay 120 is not shown for easier understanding. A plurality of (herein, four) compression springs (biasing members) 123 are disposed between the lid member 90 and the main body stay 120, and the lid member 90 is biased downward at all times by the compression springs 123. In the lid member 90, a plurality of (herein, four) bent pieces 91 that are bent upward are formed adjacently to the compression springs 123, respectively. Two of the bent pieces 91 that are disposed in the arrow A' direction each has a lid support portion 91*a* that is formed by bending an upper end thereof in the horizontal direction. An insertion hole 120*a* into which each of the bent pieces 91 is inserted is formed in the main body stay 120. The bent pieces 91 are slightly movable in the up-down direction with respect to the insertion holes 120*a*, respectively.

Lid support pins 124 that are inserted into penetration holes 92 of the lid member 90 are mounted to portions of the main body stay 120 in the arrow A direction. The penetration holes 92 are slightly movable in the up-down direction with respect to the lid support pins 124, respectively. The lid support portions 91*a* are engaged with edge portions of the insertion holes 120*a*, respectively, and edge portions of the penetration holes 92 are engaged with lower portions of the lid support pins 124, respectively, and thus the lid member 90 is supported to the main body stay 120.

Furthermore, a plurality of rollers 125 are rotatably mounted to each of both ends of the lid member 90 in the arrow BB' direction.

Figure 19:
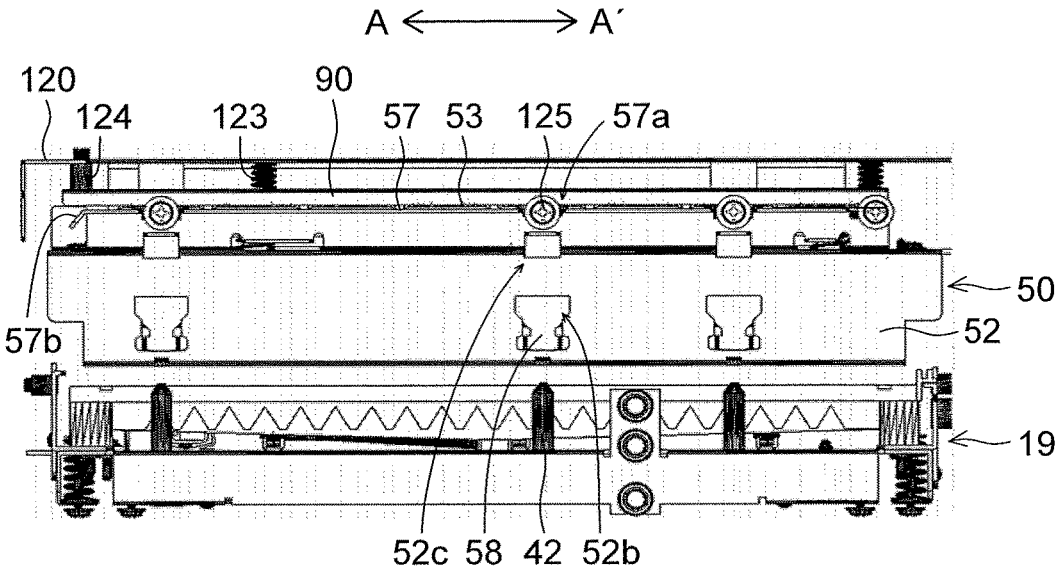
FIG. 19 is a view showing a structure of the cap unit, the wipe unit, and so on of the printer according to the one embodiment of the present disclosure, which illustrates a state where the wipe unit is disposed at a first height position.

As shown in FIG. 10, a roller sliding rail 57 whose upper end is bent in the horizontal direction is provided on each of both ends of the upper surface of the cap tray 51 of the cap unit 50 in the arrow BB' direction. As shown in FIG. 10 and FIG. 19, a cutout 57*a* is formed at a position on the roller sliding rail 57, which corresponds to each of the rollers 125. The cutout 57*a* is formed in such a size that each of the rollers 125 can be fitted thereinto. Furthermore, an inclined portion 57*b* that is inclined downward toward the arrow A direction is formed at an end portion of the roller sliding rail 57 in the arrow A direction.

Furthermore, in each of the tray side plates 52 of the cap unit 50, at positions below the cutouts 57*a*, there are formed a plurality of opening holes 52*b* that each slidably guide a push-up piece (a separation member) 58 in the up-down direction and an insertion hole 52*c* into which an upper portion of the push-up piece 58 is inserted.

Figure 20:
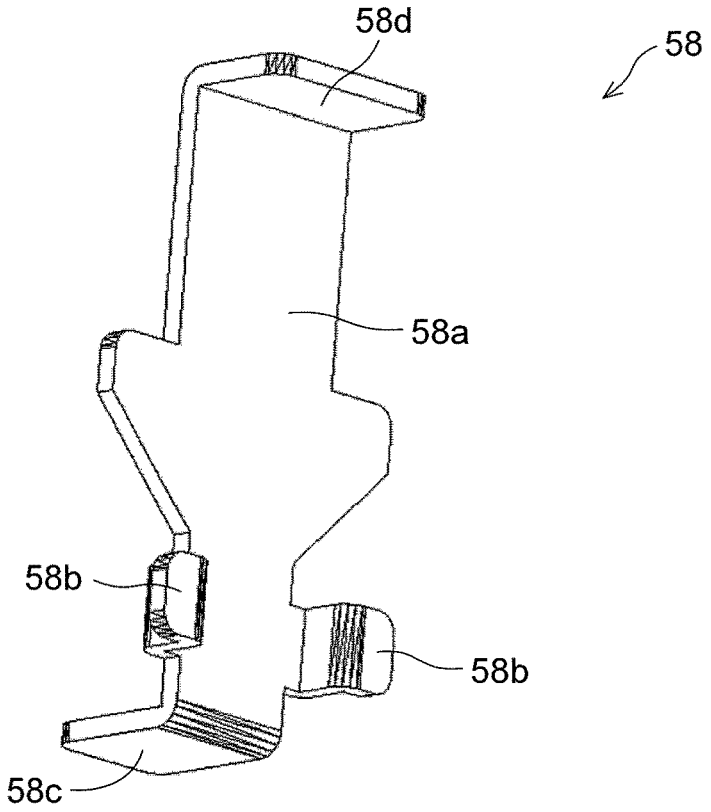
FIG. 20 is a view showing a structure of the push-up piece of the printer according to the one embodiment of the present disclosure.

The push-up piece 58 is provided in the cap unit 50 so as to be movable in the up-down direction. Furthermore, the purpose of providing the push-up piece 58 is to push up the lid member 90 so that the lid member 90 is separated from the cap unit 50 when the cap unit 50 is moved from the second position to the first position. As shown in FIG. 19 and FIG. 20, the push-up piece 58 has a piece main body 58*a* that is disposed so as to be opposed to an inner surface of each of the tray side plates 52, a pair of engagement protrusions 58*b* that protrude outward through each of the opening holes 52*b* and are engaged with edge portions of the each of the opening holes 52*b*, a bent bottom portion 58*c* that is formed by bending a lower portion of the piece main body 58*a* in the horizontal direction, and a bent upper portion 58*d* that is formed by bending an upper portion of the piece main body 58*a* in the horizontal direction.

As shown in FIG. 19, in a state where, at the second position, the wipe unit 19 is disposed at the first height position (the lowered position, a position at which the wipe unit 19 is placed on the carriage bottom plate 81), the joint pins 42 are each disposed below and at a prescribed distance from (separated from) the bent bottom portion 58*c* (see FIG. 20) of the push-up piece 58. Thus, the push-up piece 58 is disposed at a lowermost position (a position at which the engagement protrusions 58*b* come into contact with a lower edge portion of each of the opening holes 52*b*). At this time, each of the rollers 125 is fitted into the cutout 57*a*, and thus the lid member 90 is in tight contact with the cap portions 53. Furthermore, a gap is formed between the bent upper portion 58*d* (see FIG. 20) of the push-up piece 58 and each of the rollers 125.

Figure 21:
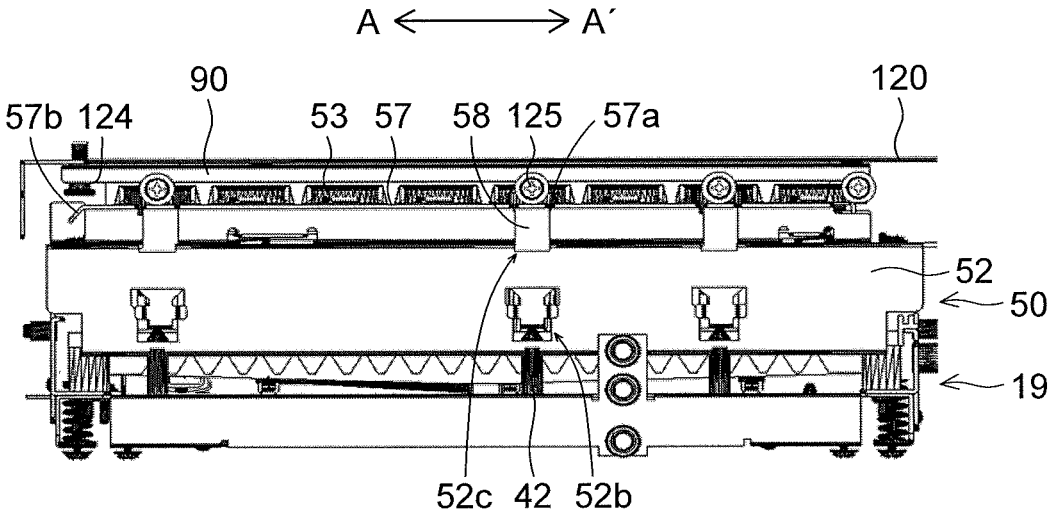
FIG. 21 is a view showing a structure of the cap unit, the wipe unit, and so on of the printer according to the one embodiment of the present disclosure, which illustrates a state where the wipe unit is disposed at a second height position.

On the other hand, as shown in FIG. 16 and FIG. 21, when, at the second position, the wipe unit 19 ascends to a second height position (a position shown in FIG. 16 and FIG. 21) higher than the first height position, the joint pins 42 are inserted into the joint holes 52*a* of the cap unit 50 and each push up the bent bottom portion 58*c* of the push-up piece 58 via each of the joint holes 52*a*. Thus, the bent upper portion 58*d* of the push-up piece 58 pushes up each of the rollers 125, and thus the lid member 90 is separated upward from the cap portions 53. At this time, the bent upper portion 58*d* is disposed so as to be flush with the roller sliding rail 57 and constitutes part of the roller sliding rail 57.

Figure 22:
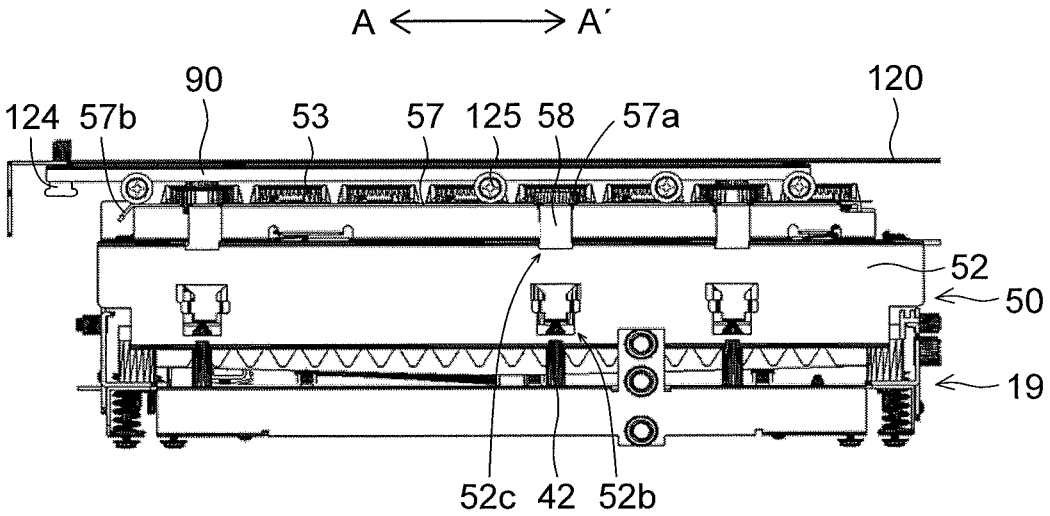
FIG. 22 is a view illustrating a state where the cap unit and the wipe unit have been slightly moved in an arrow A' direction from the state shown in FIG. 21.

The carriage 80 (see FIG. 14) is horizontally moved from this state in the arrow A' direction toward the first position, and thus, as shown in FIG. 22, the cap unit 50 horizontally moves toward the first position integrally with the wipe unit 19. At this time, the rollers 125 are supported by the roller sliding rail 57, and thus a separated state between the lid member 90 and the cap portions 53 is maintained. Furthermore, the rollers 125 rotate on an upper surface 57*c* (see FIG. 24) of the roller sliding rail 57, and thus horizontal movement of the cap unit 50 is made smooth.

Figure 23:
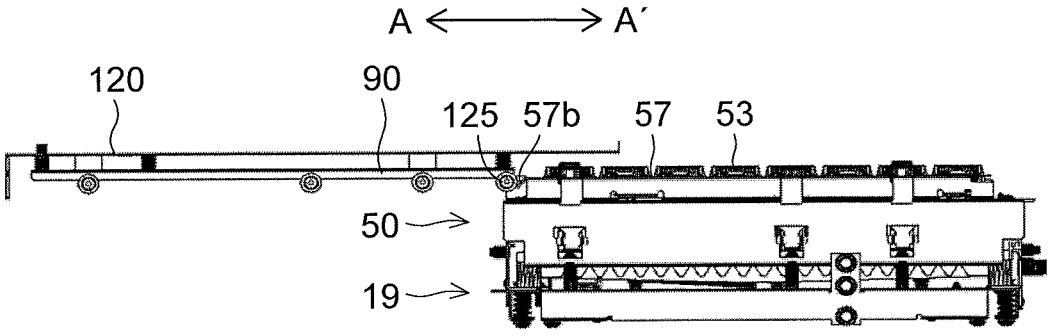
FIG. 23 is a view showing a structure of the cap unit, the wipe unit, and so on of the printer according to the one embodiment of the present disclosure, which illustrates a state where the cap unit and the wipe unit are being moved from the first position to the second position.
Figure 24:
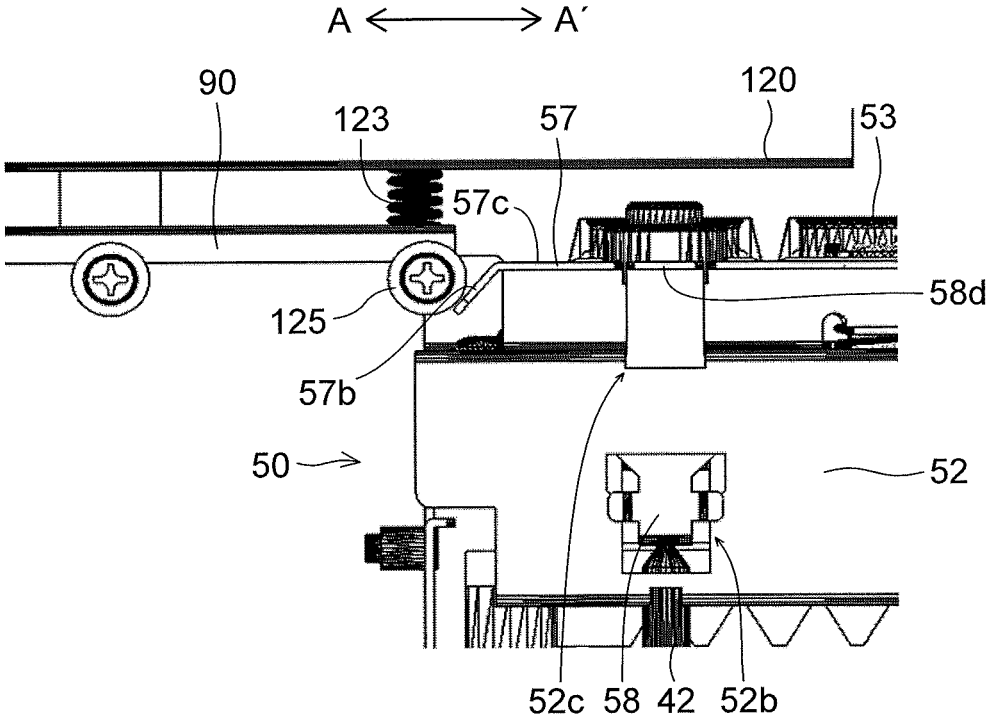
FIG. 24 is an enlarged view showing a vicinity of an inclined portion shown in FIG. 23.

In a state where the cap unit 50 is disposed at the first position, the lid member 90 has slightly moved downward and is supported to the main body stay 120. When, in this state, the cap unit 50 is horizontally moved in the arrow A direction from the first position toward the second position, as shown in FIG. 23 and FIG. 24, by the inclined portion 57*b* of the roller sliding rail 57, the rollers 125 are guided onto the upper surface 57*c* of the roller sliding rail 57, and thus the lid member 90 is lifted. With this configuration, the cap unit 50 moves to the second position in a state where the lid member 90 and the cap portions 53 are separated from each other.

Next, a detailed description is given of the moisture-retaining agent supply mechanism 130 that supplies a moisture-retaining agent into each of the cap portions 53.

Figure 25:
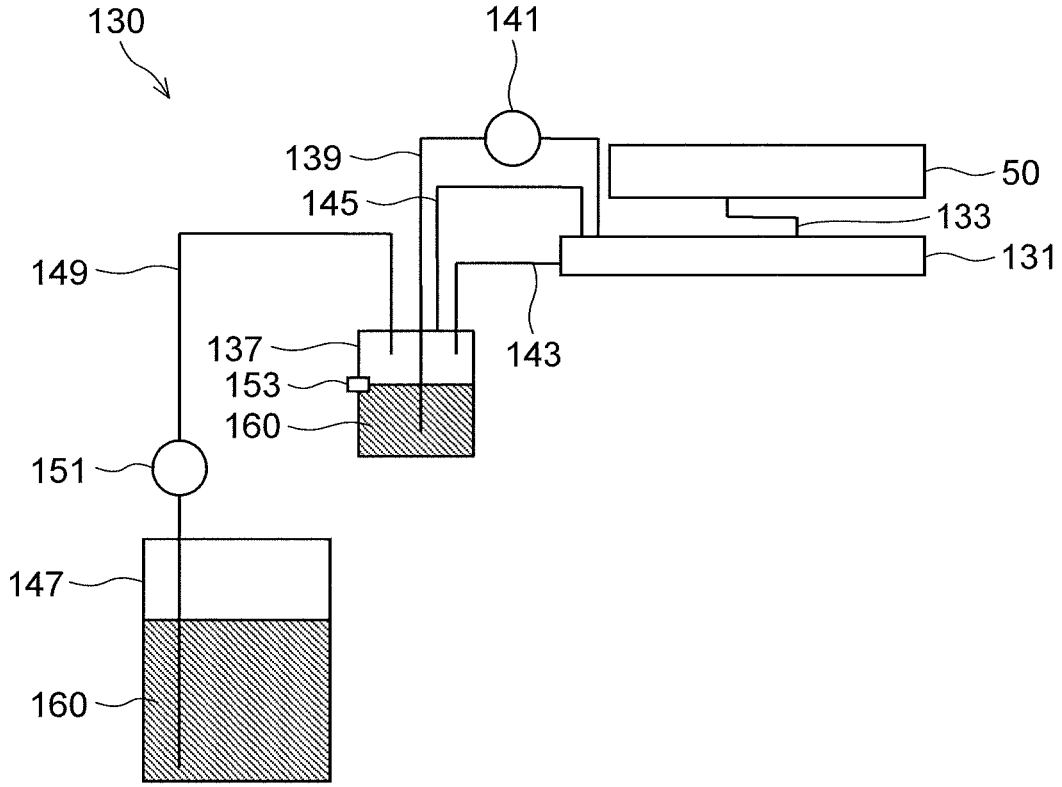
FIG. 25 is a view showing a configuration in a vicinity of a moisture-retaining agent supply mechanism of the printer according to the one embodiment of the present disclosure.

As shown in FIG. 25, the moisture-retaining agent supply mechanism 130 is composed of a moisture-retaining agent housing portion 131, a communication path 133, a liquid-absorbing member 135 (see FIG. 29), a sub-tank (a moisture-retaining agent tank) 137, a supply path 139, a supply pump 141, a discharge path 143, an air passage path 145, a main tank (a replenishment tank) 147, a replenishment path 149, a replenishment pump 151, and a detection sensor 153.

Figure 26:
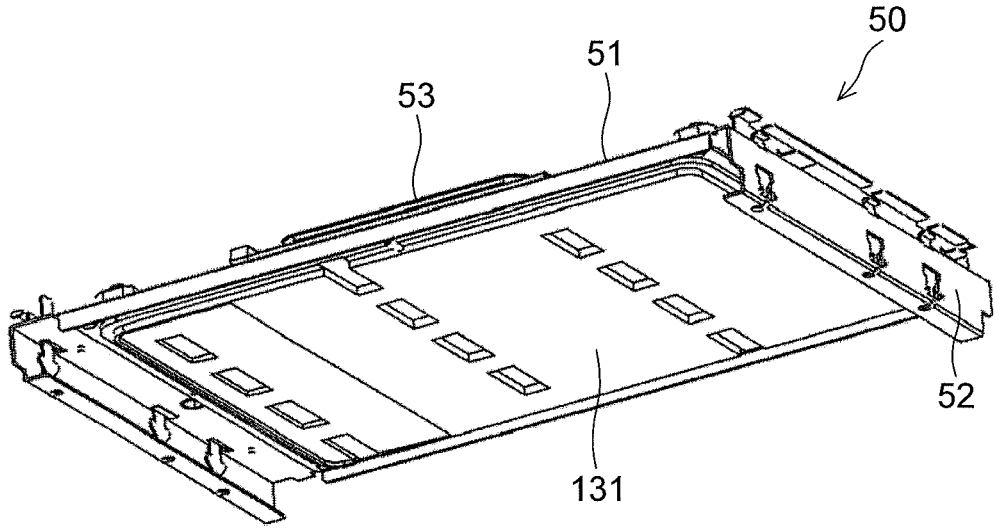
FIG. 26 is a view showing, from obliquely below, a structure of the cap unit and a moisture-retaining agent housing portion.
Figure 27:
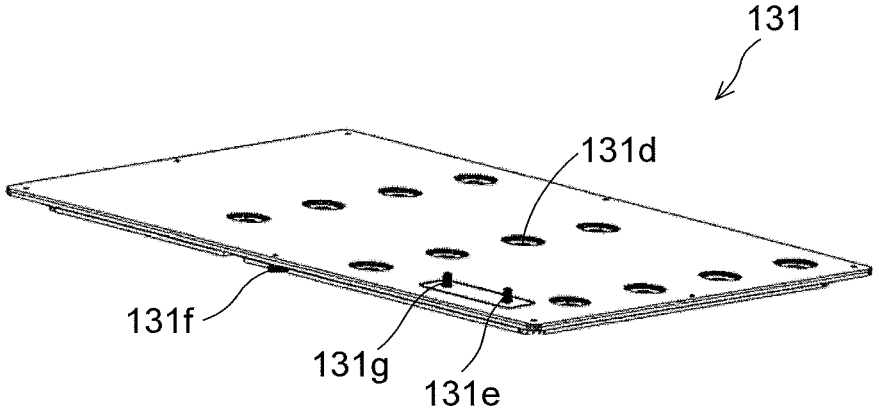
FIG. 27 is a view showing, from obliquely above, a structure of the moisture-retaining agent housing portion.

As shown in FIG. 26 and FIG. 27, the moisture-retaining agent housing portion 131 is formed in such a shape as to be larger in a forward-backward direction and in a left-right direction and smaller in a height direction, and mounted to a lower surface of the cap tray 51 so as to cover an entire lower region of the cap portions 53. The moisture-retaining agent housing portion 131 houses a moisture-retaining agent 160 (see FIG. 25) to be supplied into each of the cap portions 53. As the moisture-retaining agent 160, water (pure water) is used herein.

Figure 28:
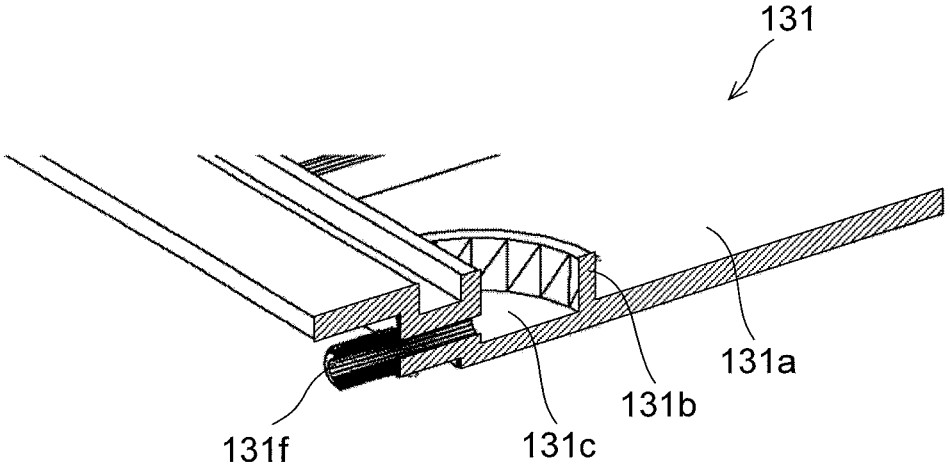
FIG. 28 is a view showing a sectional structure in a vicinity of a partition wall of the moisture-retaining agent housing portion.

As shown in FIG. 28, inside the moisture-retaining agent housing portion 131, there are provided a storage chamber 131*a* that stores the liquid-state moisture-retaining agent 160 supplied from the sub-tank 137, a partition wall 131*b* that constitutes part of a side wall of the storage chamber 131*a* and is formed between the storage chamber 131*a* and an after-mentioned discharge port 131*f*, and a discharge chamber 131*c* that is disposed on an outer side of the partition wall 131*b* (between the partition wall 131*b* and an outer wall of the moisture-retaining agent housing portion 131). The storage chamber 131*a* is provided to extend over most of a region inside the moisture-retaining agent housing portion 131. The partition wall 131*b* is formed to have a prescribed height, protruding upward from a bottom surface of the moisture-retaining agent housing portion 131, so as to be a prescribed distance away from an upper surface of the moisture-retaining agent housing portion 131. That is, a gap is formed between the partition wall 131*b* and the upper surface of the moisture-retaining agent housing portion 131 so that, when the moisture-retaining agent 160 in an amount more than necessary is supplied to the storage chamber 131*a*, an excess of the moisture-retaining agent 160 flows over the partition wall 131*b* into the discharge chamber 131*c*. The discharge chamber 131*c* has a substantially semi-circular shape and is formed in a narrow region inside the moisture-retaining agent housing portion 131.

Figure 29:
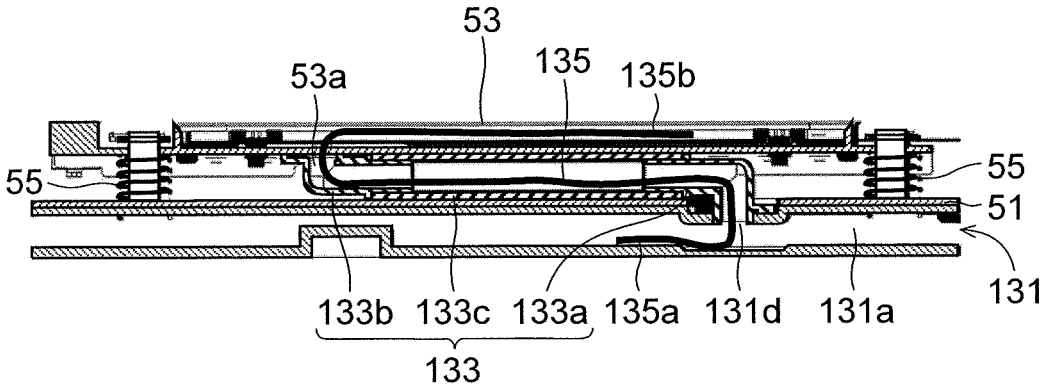
FIG. 29 is a view showing a sectional structure in a vicinity of the moisture-retaining agent housing portion and a cap portion.

As shown in FIG. 27 and FIG. 29, on the upper surface of the moisture-retaining agent housing portion 131, a plurality of (herein, 12) upper communication holes 131*d* for supplying the moisture-retaining agent 160 into the cap portions 53 are formed so as to correspond to the cap portions 53, respectively. The upper communication holes 131*d* are formed on an upper surface of the storage chamber 131*a*.

Figure 30:
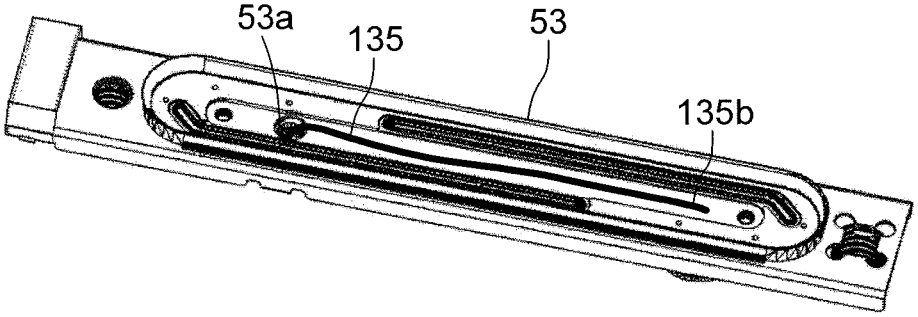
FIG. 30 is a view showing a structure of the cap portion.
Figure 31:
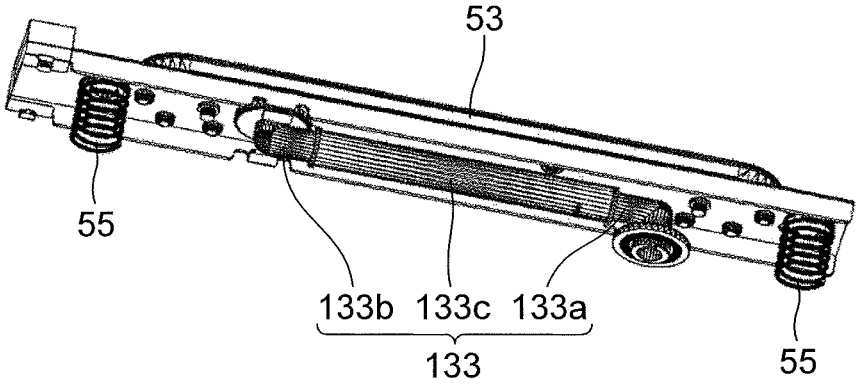
FIG. 31 is a view showing, from obliquely below, a structure of the cap portion and a joint path.
Figure 32:
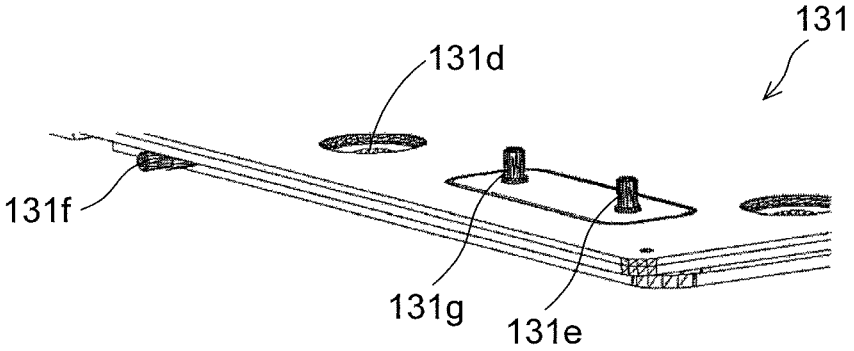
FIG. 32 is a view showing a structure in a vicinity of a supply port and a discharge port of the moisture-retaining agent housing portion.

As shown in FIG. 29 and FIG. 30, a lower communication hole 53*a* is formed on a bottom surface of each of the cap portions 53. Each of the upper communication holes 131*d* and the lower communication hole 53*a* are connected to each other via a communication path 133 through which the moisture-retaining agent 160 being supplied from the moisture-retaining agent housing portion 131 to the cap portions 53 passes. As shown in FIG. 29 and FIG. 31, the communication path 133 is composed of an L-shaped securing metal fitting 133*a* secured to each of the upper communication holes 131*d*, an L-shaped securing metal fitting 133*b* secured to the lower communication hole 53*a*, and a tube 133*c* that is made of, for example, polyethylene, polypropylene, or the like and connects the securing metal fittings 133*a* and 133*b* to each other.

In the communication path 133, the liquid-absorbing member 135 is provided that has a function of absorbing the liquid-state moisture-retaining agent 160. As the liquid-absorbing member 135, a belt-shaped or cord-shaped member made of, for example, nonwoven fabric, cotton, sponge, or the like can be used. One end 135*a* of the liquid-absorbing member 135 is soaked in the liquid-state moisture-retaining agent 160 in the moisture-retaining agent housing portion 131, and the other end 135*b* thereof is disposed inside each of the cap portions 53. With this configuration, when moisture inside each of the cap portions 53 is decreased, the moisture-retaining agent 160 is evaporated from the other end 135*b* of the liquid-absorbing member 135, and by a capillary phenomenon, from the one end 135*a* thereof, the moisture-retaining agent 160 is sucked up in an amount corresponding to an evaporation amount of the moisture-retaining agent 160.

As shown in FIG. 25, the sub-tank 137 houses the liquid-state moisture-retaining agent 160 to be supplied to the moisture-retaining agent housing portion 131. An upstream end of the supply path 139 is connected to the sub-tank 137. The supply path 139 is formed of a tube, and the moisture-retaining agent 160 being supplied from the sub-tank 137 to the moisture-retaining agent housing portion 131 passes therethrough. A downstream end of the supply path 139 is connected to a supply port 131*e* (see FIG. 32) provided in the moisture-retaining agent housing portion 131. The supply port 131*e* is provided on the upper surface of the storage chamber 131*a* of the moisture-retaining agent housing portion 131.

In the supply path 139, the supply pump 141 is provided that pumps up the moisture-retaining agent 160 from the sub-tank 137 and feeds it to the moisture-retaining agent housing portion 131. The supply pump 141 supplies, from the sub-tank 137 to the moisture-retaining agent housing portion 131, the moisture-retaining agent 160 in an amount not less than a consumption amount of the moisture-retaining agent 160 (an amount of moisture decreased) in the cap portions 53.

Furthermore, a downstream end of the discharge path 143 is connected to the sub-tank 137. The discharge path 143 is formed of a tube, and part of the moisture-retaining agent 160 that has overflowed (that has flowed over the partition wall 131*b*) inside the moisture-retaining agent housing portion 131 and returns from the moisture-retaining agent housing portion 131 to the sub-tank 137 passes therethrough. An upstream end of the discharge path 143 is connected to the discharge port 131*f* (see FIG. 32) provided in the moisture-retaining agent housing portion 131. As shown in FIG. 28, the discharge port 131*f* is provided on a side surface of the discharge chamber 131*c* of the moisture-retaining agent housing portion 131. That is, the discharge port 131*f* is provided at a position lower in level than the supply port 131*e* (see FIG. 32). Furthermore, the discharge port 131*f* is disposed at a position lower in level than an upper end of the partition wall 131*b*. Consequently, part of the moisture-retaining agent 160 that has overflowed over the partition wall 131*b* returns to the sub-tank 137 via the discharge port 131*f* and the discharge path 143.

Furthermore, as shown in FIG. 25, a downstream end of the air passage path 145 is connected to the sub-tank 137. The air passage path 145 is formed of a tube, and air passes therethrough. An upstream end of the air passage path 145 is connected to an air slot 131*g* (see FIG. 32) of the moisture-retaining agent housing portion 131. The air slot 131*g* is provided on the upper surface of the moisture-retaining agent housing portion 131.

In the printer 100, when an accumulated length of time obtained by accumulating a length of time in which the ink ejection surfaces F of the recording heads 17*a* to 17*c* are capped with the cap portions 53, an accumulated length of time obtained by accumulating a length of time in which a printing operation and a recovery operation are performed, or an accumulated length of time obtained by totalizing these accumulated lengths of time has exceeded a prescribed length of time, based on a control signal from the control portion 110 (see FIG. 1), the supply pump 141 is driven to supply the moisture-retaining agent 160 from sub-tank 137 to the moisture-retaining agent housing portion 131. At this time, air in an amount corresponding to an increase in amount of the moisture-retaining agent 160 inside the moisture-retaining agent housing portion 131 moves from the moisture-retaining agent housing portion 131 to the sub-tank 137 via the air passage path 145. The supply pump 141 is configured to be driven before the moisture-retaining agent 160 in the storage chamber 131*a* runs out and to supply, to the moisture-retaining agent housing portion 131, the moisture-retaining agent 160 in an amount more than an amount of moisture (the moisture-retaining agent 160) consumed (decreased) in the cap portions 53. Consequently, the moisture-retaining agent 160 in the storage chamber 131*a* is prevented from running out. Furthermore, an excess of the moisture-retaining agent 160 overflows over the partition wall 131*b* from the storage chamber 131*a* and returns to the sub-tank 137 via the discharge port 131*f* and the discharge path 143.

The main tank 147 houses the liquid-state moisture-retaining agent 160 to be supplied to the sub-tank 137. An upstream end of the replenishment path 149 is connected to the main tank 147. The replenishment path 149 is formed of a tube, and the moisture-retaining agent 160 being supplied from the main tank 147 to the sub-tank 137 passes therethrough. A downstream end of the replenishment path 149 is connected to an upper surface of the sub-tank 137.

In the replenishment path 149, the replenishment pump 151 is provided that pumps up the moisture-retaining agent 160 from the main tank 147 and feeds it to the sub-tank 137. As each of the supply pump 141 and the replenishment pump 151, for example, a tube pump, a syringe pump, a diaphragm pump, or the like can be used.

Furthermore, at a prescribed position in the sub-tank 137, a detection sensor 153 is provided that detects a remaining amount of the moisture-retaining agent 160 inside the sub-tank 137. As the detection sensor 153, for example, a level sensor or the like may be used. Upon detection by the detection sensor 153 that the liquid is absent (the liquid is in an amount less than a prescribed value), until it is detected that the liquid is present (the liquid is in an amount not less than the prescribed value), the replenishment pump 151 replenishes the sub-tank 137 with the moisture-retaining agent 160 from the main tank 147. Consequently, a liquid level (an upper surface) of the moisture-retaining agent 160 in the sub-tank 137 is maintained at a substantially constant level. In a case where, even when the replenishment pump 151 has been driven, it is not detected by the detection sensor 153 that the liquid is present (the liquid is in an amount not less than the prescribed value), on a display panel (not shown) of the printer 100, a notification is displayed that the main tank 147 has become empty. The main tank 147 will then be replaced with a new one by a user or an operator.

Next, a description is given of an operation of mounting the cap unit 50 to the recording heads 17*a* to 17*c* (a capping operation) in the printer 100 of this embodiment. A capping operation and a recovery operation described below are carried out by controlling operations of the recording heads 17*a* to 17*c*, the wipe unit 19, the unit ascending/descending mechanism 60, the unit horizontal movement mechanism 85, the conveyance ascending/descending mechanism, various drive sources, or the like based on a control signal from the control portion 110 (see FIG. 1).

In a case of capping the recording heads 17*a* to 17*c* with the cap unit 50, as shown in FIG. 7, the first conveyance unit 5 disposed so as to be opposed to a lower surface of the recording portion 9 (see FIG. 1) is caused to descend. At this time, as shown in FIG. 19, the wipe unit 19 is disposed at the first height position, and thus the wipe unit 19 and the cap unit 50 are not joined to each other. Furthermore, the lid member 90 is in tight contact with the cap portions 53 of the cap unit 50.

Then, by the unit ascending/descending mechanism 60 (see FIG. 14), as shown in FIG. 21, the wipe unit 19 is caused to ascend from the first height position to the second height position. Consequently, as shown in FIG. 16, the joint pins 42 are inserted into the joint holes 52*a*, and thus the wipe unit 19 and the cap unit 50 are joined to each other. At this time, as shown in FIG. 21, the lid member 90 is pushed up by the joint pins 42 and the push-up pieces 58 and thus is separated from the cap portions 53 of the cap unit 50.

After that, as shown in FIG. 8, the carriage 80 is horizontally moved from the second position to the first position, and thus in a state of being joined to an upper surface of the wipe unit 19, the cap unit 50 horizontally moves from the second position to the first position.

Then, by the unit ascending/descending mechanism 60, as shown in FIG. 9, the wipe unit 19 and the cap unit 50 are caused to ascend. At a point in time when the cap portions 53 of the cap unit 50 come into tight contact with the ink ejection surfaces F of the recording heads 17*a* to 17*c*, the winding drive motor 64 (see FIG. 14) is stopped from rotating, and thus capping of the recording heads 17*a* to 17*c* of the cap unit 50 is completed.

In a case of cancelling capping of the recording heads 17*a* to 17*c* (in a case of shifting to a printing operation or a recovery operation), an operation performed is reverse to the above-described operation and, therefore, is only briefly described.

At the first position, by the unit ascending/descending mechanism 60, the wipe unit 19 and the cap unit 50 are caused to descend until the wipe unit 19 is disposed at the second height position. Consequently, the cap portions 53 are separated from the ink ejection surfaces F. Then, the carriage 80 is horizontally moved from the first position to the second position, and thus the wipe unit 19 and the cap unit 50 are disposed at the second position in a state of being joined to each other.

After that, at the second position, by the unit ascending/descending mechanism 60, the wipe unit 19 is caused to descend from the second height position to the first height position. Consequently, the joint pins 42 are pulled out from the joint holes 52*a*, and thus the wipe unit 19 and the cap unit 50 are disjoined from each other. At this time, the joint pins 42 are separated from the push-up pieces 58, causing the push-up pieces 58 to descend, so that the lid member 90 comes into tight contact with the cap portions 53. In this manner, the state shown in FIG. 7 and FIG. 19 is restored.

Next, a description is given of a recovery operation with respect to the recording heads 17*a* to 17*c* in the printer 100 of this embodiment. In a case of performing a recovery process with respect to the recording heads 17*a* to 17*c* by using the wipe unit 19, as shown in FIG. 7, the first conveyance unit 5 disposed so as to be opposed to the lower surface of the recording portion 9 (see FIG. 1) is caused to descend. At this time, as shown in FIG. 19, the wipe unit 19 is disposed at the first height position, and thus the wipe unit 19 and the cap unit 50 are not joined to each other. Furthermore, the lid member 90 is in tight contact with the cap portions 53 of the cap unit 50.

Then, as shown in FIG. 11, in a state where the cap unit 50 is left at the second position, the carriage 80 is horizontally moved from the second position to the first position, and thus the wipe unit 19 is horizontally moved at the first height position from the second position to the first position.

Then, by the unit ascending/descending mechanism 60, the wipe unit 19 is caused to ascend as shown in FIG. 12. Consequently, the wipers 35*a* to 35*c* of the wipe unit 19 are brought into pressure contact with respective wiping start positions of the ink ejection surfaces F of the recording heads 17*a* to 17*c*.

Then, prior to a wiping operation, ink is supplied to the recording heads 17*a* to 17*c*. The ink thus supplied is forcibly extruded (purged) through the ejection nozzles 18 (see FIG. 2). By this purging operation, thickened ink, a foreign substance, and air bubbles in the ejection nozzles 18 are discharged. At this time, purged ink is extruded on the ink ejection surface F along a shape of the nozzle region R (see FIG. 5) in which the ejection nozzles 18 are present.

After that, a wiping operation is performed in which the ink (the purged ink) extruded on the ink ejection surfaces F is wiped off. Specifically, the wiper carriage movement motor 45 is caused to rotate forward from the state shown in FIG. 12, so that the wiper carriage 31 horizontally moves in the arrow B direction as shown in FIG. 13, and thus the wipers 35*a* to 35*c* wipe off the ink extruded on the ink ejection surfaces F of the recording heads 17*a* to 17*c*. Waste ink thus wiped off by the wipers 35*a* to 35*c* is collected in the ink collection tray 44 disposed in the wipe unit 19.

After that, by the unit ascending/descending mechanism 60 (see FIG. 14), as shown in FIG. 11, the wipe unit 19 is caused to descend to the first height position, and thus the wipers 35*a* to 35*c* are separated downward from the ink ejection surfaces F of the recording heads 17*a* to 17*c*. Thereafter, the wiper carriage 31 is moved in a direction (an arrow B' direction) opposite to a wiping direction, and thus the wipe unit 19 is brought back to an original state.

Then, the carriage 80 and the wipe unit 19 disposed at the first position are horizontally moved from the first position to the second position. Consequently, the wipe unit 19 is disposed below the cap unit 50. In this manner, the recovery operation with respect to the recording heads 17*a* to 17*c* is completed.

In this embodiment, as described above, the moisture-retaining agent supply mechanism 130 includes the moisture-retaining agent housing portion 131 that houses the liquid-state moisture-retaining agent 160, the sub-tank 137 that houses the liquid-state moisture-retaining agent 160 to be supplied to the moisture-retaining agent housing portion 131, the supply path 139 through which the moisture-retaining agent 160 being supplied from the sub-tank 137 to the moisture-retaining agent housing portion 131 passes, and the discharge path 143 through which part of the moisture-retaining agent 160 passes, which has overflowed inside the moisture-retaining agent housing portion 131 and returns from the moisture-retaining agent housing portion 131 to the sub-tank 137. With this configuration, an excess of the moisture-retaining agent 160 inside the moisture-retaining agent housing portion 131 returns to the sub-tank 137 via the discharge path 143, and thus the moisture-retaining agent 160 in an amount not less than a consumption amount of the moisture-retaining agent 160 (an amount of moisture decreased) in the cap portions 53 can be supplied from the sub-tank 137 to the moisture-retaining agent housing portion 131. Thus, even in a case where the moisture-retaining agent housing portion 131 is small in a height direction, making it difficult to detect a remaining amount of the moisture-retaining agent 160 in the moisture-retaining agent housing portion 131, the moisture-retaining agent 160 can be stably supplied from the sub-tank 137 to the moisture-retaining agent housing portion 131, and thus it is possible to suppress running out of the moisture-retaining agent 160 in the moisture-retaining agent housing portion 131, and thus to suppress thickening of ink in the ejection nozzles 18.

Furthermore, as described above, the moisture-retaining agent supply mechanism 130 includes the supply pump 141 that is provided in the supply path 139 and feeds, from the sub-tank 137 to the moisture-retaining agent housing portion 131, the moisture-retaining agent 160 in an amount not less than a consumption amount of the moisture-retaining agent 160 in the cap portions 53. With this configuration, the moisture-retaining agent 160 can be stably supplied with ease from the sub-tank 137 to the moisture-retaining agent housing portion 131.

Furthermore, as described above, the moisture-retaining agent housing portion 131 has the supply port 131*e* to which the supply path 139 is connected and the discharge port 131*f* that is provided at a position lower in level than the supply port 131*e* and to which the discharge path 143 is connected. With this configuration, while being prevented from flowing backward through the supply path 139, an excess of the moisture-retaining agent 160 can be easily made to return to the sub-tank 137 via the discharge path 143.

Furthermore, as described above, the moisture-retaining agent housing portion 131 has the storage chamber 131*a* and the partition wall 131*b* that constitutes part of the side wall of the storage chamber 131*a* and is formed between the storage chamber 131*a* and the discharge port 131*f*, and the discharge port 131*f* is disposed at a position lower in level than the upper end of the partition wall 131*b*. With this configuration, an amount of the moisture-retaining agent 160 inside the moisture-retaining agent housing portion 131 can be retained substantially constant by the partition wall 131*b*, and part of the moisture-retaining agent 160 that has overflowed over the partition wall 131*b* can be easily made to return to the sub-tank 137.

Furthermore, as described above, the moisture-retaining agent supply mechanism 130 includes the air passage path 145 that connects the moisture-retaining agent housing portion 131 to the sub-tank 137 and through which air passes. With this configuration, an air pressure inside the moisture-retaining agent housing portion 131 and the sub-tank 137 can be made substantially uniform, and thus a flow of the moisture-retaining agent 160 passing through the supply path 139 and a flow of the moisture-retaining agent 160 passing through the discharge path 143 can be made smooth. Furthermore, unlike a case where the moisture-retaining agent housing portion 131 is provided with an atmosphere open port for making an air pressure in an inner space equal to an atmospheric pressure, it is possible to suppress consumption (release into the atmosphere) of the moisture-retaining agent 160 in the moisture-retaining agent housing portion 131.

Furthermore, as described above, in the communication path 133, the liquid-absorbing member 135 is provided that has a function of absorbing the liquid-state moisture-retaining agent 160 and has the one end 135*a* thereof soaked in the moisture-retaining agent 160 in the moisture-retaining agent housing portion 131 and the other end 135*b* thereof disposed inside each of the cap portions 53. With this configuration, when moisture (the moisture-retaining agent 160) inside each of the cap portions 53 is decreased, the moisture-retaining agent 160 is evaporated from the other end 135*b* of the liquid-absorbing member 135, and by a capillary phenomenon, from the one end 135*a* thereof, the moisture-retaining agent 160 is sucked up in an amount corresponding to an evaporation amount of the moisture-retaining agent 160. Thus, it is possible to easily suppress drying inside each of the cap portions 53.

Furthermore, as described above, in the sub-tank 137, the detection sensor 153 is provided that detects a remaining amount of the moisture-retaining agent 160 in the sub-tank 137. With this configuration, upon detection by the detection sensor 153 that a remaining amount of the moisture-retaining agent 160 in the sub-tank 137 is less than a prescribed value, from the main tank 147, the sub-tank 137 is replenished with the moisture-retaining agent 160. Furthermore, in a case where, even when a replenishment operation has been performed, a remaining amount of the moisture-retaining agent 160 inside the sub-tank 137 is not increased, on a display panel (not shown) of the printer 100, a notification is displayed that the main tank 147 has become empty. The main tank 147 will then be replaced with a new one by a user or an operator.

Furthermore, as described above, there is provided the lid member 90 that comes into tight contact with the cap portions 53 at the second position (the retracted position). With this configuration, it is possible to suppress consumption of the moisture-retaining agent 160 (a decrease in amount of moisture inside the cap portions 53) at a time of a non-capping operation (a time of a printing operation and a time of a recovery operation).

The embodiment disclosed herein is to be construed in all respects as illustrative and not limiting. The scope of the present disclosure is indicated by the appended claims rather than by the foregoing description of the embodiment, and all changes that come within the meaning and range of equivalency of the claims are intended to be embraced therein.

For example, while the foregoing embodiment has presented an example in which the partition wall 131*b* is provided in the moisture-retaining agent housing portion 131, the present disclosure is not limited thereto. For example, inside the moisture-retaining agent housing portion 131, only the storage chamber 131*a* may be provided without providing the partition wall 131*b* and the discharge chamber 131*c*. In this case, a configuration may be adopted in which, with the discharge port 131*f* provided at a prescribed height position on the side wall of the storage chamber 131*a*, the moisture-retaining agent 160 is stored in a constant amount corresponding to the height position of the discharge port 131*f*, and part of the moisture-retaining agent 160 that has reached the discharge port 131*f* and overflowed returns to the sub-tank 137.

Furthermore, while the foregoing embodiment has presented an example in which water (pure water) is used as the moisture-retaining agent 160, the present disclosure is not limited thereto. The moisture-retaining agent 160 may be of any different type so as to correspond to a type of ink used.

Furthermore, while the foregoing embodiment has presented an example in which the liquid-absorbing member 135 is provided in the communication path 133, the present disclosure is not limited thereto. For example, by sufficiently increasing an inner diameter of the communication path 133 or sufficiently decreasing a path length of the communication path 133, moisture in the air (a gas-state moisture-retaining agent 160) inside the moisture-retaining agent housing portion 131 can be supplied into each of the cap portions 53.

Furthermore, while the foregoing embodiment has presented an example in which the moisture-retaining agent 160 is supplied from the sub-tank 137 to the moisture-retaining agent housing portion 131 by the supply pump 141 provided in the supply path 139, the present disclosure is not limited thereto. For example, the moisture-retaining agent 160 may be supplied from the sub-tank 137 to the moisture-retaining agent housing portion 131 by causing the sub-tank 137 to ascend/descend.

What is claimed is:

1. An ink-jet recording apparatus, comprising:

a plurality of recording heads that each have an ink ejection surface on which an ejection nozzle for ejecting ink is open;

a cap unit that has a plurality of cap portions that each cap the ink ejection surface; and a moisture-retaining agent supply mechanism that supplies a moisture-retaining agent in a liquid state or a gas state into each of the plurality of cap portions, wherein the moisture-retaining agent supply mechanism includes:

a moisture-retaining agent housing portion that is provided below the plurality of cap portions and houses the liquid-state moisture-retaining agent;

a communication path that connects the moisture-retaining agent housing portion to the plurality of cap portions and through which the moisture-retaining agent being supplied from the moisture-retaining agent housing portion to the plurality of cap portions passes;

a moisture-retaining agent tank that houses the liquid-state moisture-retaining agent to be supplied to the moisture-retaining agent housing portion;

a supply path that connects the moisture-retaining agent housing portion to the moisture-retaining agent tank and through which the moisture-retaining agent being supplied from the moisture-retaining agent tank to the moisture-retaining agent housing portion passes; and a discharge path that connects the moisture-retaining agent housing portion to the moisture-retaining agent tank and through which part of the moisture-retaining agent passes, which has overflowed inside the moisture-retaining agent housing portion and returns from the moisture-retaining agent housing portion to the moisture-retaining agent tank.

2. The ink-jet recording apparatus according to claim 1, wherein the moisture-retaining agent supply mechanism further comprises a supply pump that is provided in the supply path and feeds, from the moisture-retaining agent tank to the moisture-retaining agent housing portion, the moisture-retaining agent in an amount not less than a consumption amount of the moisture-retaining agent in the plurality of cap portions.

3. The ink-jet recording apparatus according to claim 1, wherein the moisture-retaining agent housing portion has a supply port to which the supply path is connected and a discharge port that is provided at a position lower in level than the supply port and to which the discharge path is connected.

4. The ink-jet recording apparatus according to claim 3, wherein the moisture-retaining agent housing portion has a storage chamber that stores the moisture-retaining agent supplied from the moisture-retaining agent tank and a partition wall that constitutes part of a side wall of the storage chamber and is formed between the storage chamber and the discharge port, and the discharge port is disposed at a position lower in level than an upper end of the partition wall, and part of the moisture-retaining agent that has overflowed over the partition wall passes therethrough.

5. The ink-jet recording apparatus according to claim 1, wherein the moisture-retaining agent supply mechanism further comprises an air passage path that connects the moisture-retaining agent housing portion to the moisture-retaining agent tank and through which air passes.

6. The ink-jet recording apparatus according to claim 1, wherein in the communication path, a liquid-absorbing member is provided that has a function of absorbing the liquid-state moisture-retaining agent and has one end thereof soaked in the moisture-retaining agent in the moisture-retaining agent housing portion and an other end thereof disposed inside each of the plurality of cap portions.

7. The ink-jet recording apparatus according to claim 1, further comprising:

a replenishment tank that houses the liquid-state moisture-retaining agent to be supplied to replenish the moisture-retaining agent tank; and a replenishment path that connects the moisture-retaining agent tank to the replenishment tank and through which the moisture-retaining agent being supplied from the replenishment tank to replenish the moisture-retaining agent tank passes, wherein in the moisture-retaining agent tank, a detection sensor is provided that detects a remaining amount of the moisture-retaining agent in the moisture-retaining agent tank.

8. The ink-jet recording apparatus according to claim 1, further comprising:

a lid member that, at a retracted position retracted in a horizontal direction from a position directly below the plurality of recording heads, is disposed above the cap unit and comes into tight contact with the plurality of cap portions.

* * * * *